US007475957B2

(12) United States Patent
Nakazawa

(10) Patent No.: US 7,475,957 B2
(45) Date of Patent: Jan. 13, 2009

(54) INK JET RECORDING APPARATUS AND METHOD OF CONTROLLING THE SAME

(75) Inventor: Yusuke Nakazawa, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 264 days.

(21) Appl. No.: 11/076,914

(22) Filed: Mar. 11, 2005

(65) Prior Publication Data

US 2005/0200657 A1 Sep. 15, 2005

(30) Foreign Application Priority Data

Mar. 11, 2004 (JP) ..... 2004-068656

(51) Int. Cl.
*B41J 25/308* (2006.01)

(52) U.S. Cl. ..... 347/8; 347/5; 347/19; 347/55

(58) Field of Classification Search ..... 347/55, 347/8, 6, 19

See application file for complete search history.

(56) References Cited

U.S. PATENT DOCUMENTS 6,076,909 A * 6/2000 Saeki et al. ..... 347/8
6,158,844 A * 12/2000 Murakami et al. ..... 347/55
6,834,586 B1 * 12/2004 Ohsawa et al. ..... 101/466
2002/0140760 A1 * 10/2002 Bruch et al. ..... 347/19
2003/0081040 A1 * 5/2003 Therien et al. ..... 347/19

FOREIGN PATENT DOCUMENTS

JP 11-245390 A 9/1999
JP 3056109 B2 6/2000
JP 2001-239670 A 9/2001

* cited by examiner

*Primary Examiner*—Matthew Luu
*Assistant Examiner*—Henok Legesse
(74) *Attorney, Agent, or Firm*—Sughrue Mion, PLLC

(57) ABSTRACT

An ink jet recording apparatus ejects ink droplets toward a recording medium by causing an electrostatic force to act on ink containing charged colorant particles. The ink jet recording apparatus includes ink ejecting device for ejecting the ink droplets by causing a predetermined electrostatic force to act on the ink, ejection property detecting device for detecting a spontaneous ejection property of the ink droplets, and ejecting condition control device for controlling ejecting conditions for the ink droplets according to the spontaneous ejection property detected by the ejection property detecting device.

4 Claims, 9 Drawing Sheets

INK JET RECORDING APPARATUS AND METHOD OF CONTROLLING THE SAME

This application claims priority on Japanese patent application No. 2004-68656, the entire contents of which are hereby incorporated by reference. In addition, the entire contents of literatures cited in this specification are incorporated by reference.

BACKGROUND OF THE INVENTION

The present invention relates to an ink jet recording apparatus for ejecting ink droplets toward a recording medium by causing an electrostatic force to act on ink containing charged colorant particles, and a method of controlling the same.

As for a recording method with which ink droplets each containing colorant particles are ejected to record an image on a recording medium, for example, there is known an electrostatic ink jet recording system in which ejection of ink droplets is controlled by utilizing an electrostatic force through application of a predetermined voltage (drive voltage) corresponding to image data to an ejection electrode of an ink jet head, thereby recording an image corresponding to the image data on a recording medium by using ink containing charged colorant particles.

In a recording apparatus using the electrostatic ink jet recording system, since an electrostatic force acting on ink changes when a distance (gap) between an ink jet head and a recording medium, a resistance of the recording medium, physical properties of the ink or the like change, an ejection state of ink droplets changes accordingly. As a result, there is encountered a problem that an image of high image quality cannot be stably recorded since a change occurs in the recorded image.

For coping with such a problem, in order to realize an electrostatic ink jet recording apparatus capable of stabilizing recording quality by maintaining a stable ejection electric field strength, JP 3056109 B discloses a printing head gap regulating mechanism in which a gap defined between an ejection electrode and a recording medium, and a gap defined between the ejection electrode and a counter electrode for supporting the recording medium are measured, an electric field strength in the ejection electrode after insertion of the recording medium is calculated based on the measured gaps, and gap regulating means regulates a printing head gap so that conditions for achieving stable ejection are obtained.

In addition, in order to stabilize an electric field for causing ink to fly (hereinafter referred to as "ink-flying electric field") to enable an image of high image quality to be printed (recorded) on various recording media even when the recording media are different in thickness and material from one another, JP 11-245390 A discloses an ink jet recording apparatus in which a distance between an ejection electrode and a recording medium and a kind of recording medium are detected, and conditions for the application voltage to an electrode for generating an ink-flying electric field are controlled in correspondence to the detection results.

Moreover, in order to realize an electrostatic ink jet printer capable of carrying out a proper printing operation without being influenced by a conductivity of ink, JP 2001-239670 A discloses an ink jet printer in which the conductivity of ink is measured, and output time and a voltage value of a pulse signal of an ejection voltage to be applied to an electrode are corrected based on a measured value.

However, in the ink jet recording apparatus, the gap defined between the ink jet head and the recording medium, the resistance of the recording medium, and the physical properties of the ink complexly change.

The printing head gap regulating mechanism disclosed in JP 3056109 B is regarded as being able to correct a change in ejection state of the ink droplets which is caused due to the distance (gap) between the ink jet head and the recording medium. However, if the resistance of the recording medium and the physical properties of the ink change, the ejection state of the ink droplets changes accordingly.

In addition, the ink jet recording apparatus disclosed in JP 11-245390 A is also regarded as being able to correct a change in ejection state of the ink droplets which is caused due to the distance (gap) between the ink jet head and the recording medium and the resistance of the recording medium. However, if the physical properties of the ink change, the ejection state of the ink droplets changes accordingly.

Moreover, the ink jet printer disclosed in JP 2001-239670 A is regarded as being able to correct a change in ejection state of the ink droplets which is caused by a change in physical properties of the ink. However, if the gap defined between the ink jet head and the recording medium and the resistance of the recording medium change, the ejection state of the ink droplets changes accordingly.

Thus, in the ink jet recording apparatuses disclosed in JP 3056109 B, JP 11-245390 A, and JP 2001-239670 A, if a plurality of factors simultaneously change, the ejecting conditions can not be corrected in correspondence to such changes, and the ejection state of the ink droplets thus changes. Thus, there is encountered a problem that since the ejection state of the ink droplets can not be fixed, an image of high image quality can not be stably formed.

SUMMARY OF THE INVENTION

In light of the foregoing, the present invention has been made in order to solve the above-mentioned problems, and it is, therefore, an object of the present invention to provide an ink jet recording apparatus which is capable of stably ejecting ink droplets, thereby stably forming an image of high image quality.

Another object of the present invention is to provide a method of controlling the ink jet recording apparatus.

In order to attain the above-mentioned objects, a first aspect of the present invention provides an ink jet recording apparatus for ejecting ink droplets toward a recording medium by causing an electrostatic force to act on ink containing charged colorant particles, including: ink ejecting means for ejecting the ink droplets by causing a predetermined electrostatic force to act on the ink; ejection property detecting means for detecting a spontaneous ejection property of the ink droplets; and ejecting condition control means for controlling ejecting conditions for the ink droplets according to the spontaneous ejection property detected by the ejection property detecting means.

Preferably, the spontaneous ejection property is an ejection frequency of the ink droplets or the number of ejections of the ink droplets per predetermined time.

Preferably, the ejecting conditions includes at least one of a potential difference between the recording medium and the ink ejecting means, a distance between the ink ejecting means and a counter electrode disposed in positions facing the ink ejecting means, and a temperature of the ink.

Preferably, the ejection property detecting means is optical detection means or electrical detection means.

Preferably, the optical detection means includes a light emitting portion and a light receiving portion which are disposed in positions facing each other across a flight path of the ink droplets ejected by the ink ejecting means.

Preferably, the electrical detection means includes an electrode to which the ejected ink droplets adhere, and current detecting means for detecting a current which is generated when the ink droplets adhere to the electrode.

In order to attain the above-mentioned objects, a second aspect of the present invention provides a method of controlling an ink jet recording apparatus, including the steps of: ejecting ink droplets by causing an electrostatic force to act on ink containing charged colorant particles; detecting a spontaneous ejection property of the ejected ink droplets; and controlling ejecting conditions for the ink droplets in accordance with the detected spontaneous ejection property.

Preferably, the ejection property is a spontaneous ejection frequency of the ink droplets or the number of spontaneous ejections of the ink droplets per predetermined time, and the ejecting conditions include at least one of a potential difference between a recording medium and an ink ejecting means for ejecting the ink droplets, a distance between the ink ejecting means and a counter electrode provided opposite to the ink ejecting means, and a temperature of the ink.

Preferably, the distance, the temperature and the potential difference are set as an initial distance, an initial temperature and a detection potential difference at which spontaneous ejection of the ink droplets occurs, respectively, the spontaneous ejection frequency or the number of spontaneous ejections is detected at the detection potential difference; a detected value of the ejection frequency or the number of spontaneous ejections is compared with a desired value of the ejection frequency or the number of spontaneous ejections to obtain a comparison result; the potential difference, the distance and the temperature of the ink are updated according to the comparison result; the spontaneous ejection frequency or the number of spontaneous ejections is repeatedly detected while updating the potential difference, the distance and the temperature of the ink until the detected value coincides with the desired value or falls within a tolerance of the desired value; the updated potential difference, the updated distance and the updated temperature of the ink are set as a potential difference for drive, a distance for drive, and a temperature for drive, respectively, when the detected value coincides with the desired value or falls within a tolerance of the desired value; an ejection potential difference and a non-ejection potential difference between which a critical potential difference as a critical value at which spontaneous ejection of the ink droplets occurs exists are obtained by decreasing the updated potential difference; a potential difference lower than the critical potential difference, or a potential difference equal to or lower than the non-ejection electric potential is set as a bias electric potential to be applied across the ink ejecting means and the recording medium; and a difference between the potential difference for drive and the bias potential difference is set as a drive pulse potential difference.

Preferably, when the detected value is smaller than the desired value, the updating is carried out by at least one of further increasing the potential difference, shortening the distance, and increasing the ink temperature, while when the detected value is larger than the desired value, the updating is carried out by at least one of decreasing the potential difference, increasing the distance, and decreasing the ink.

In addition, preferably, when the detected value is smaller or larger than the desired value, first of all, the potential difference is further increased or decreased from the detected potential difference; when the detected value is still smaller or larger than the desired value, next, the distance is decreased or increased from the initial distance; and when the detected value is still smaller or larger than the desired value, next, the ink temperature is increased or decreased from the initial temperature.

In addition, preferably the spontaneous ejection property is a spontaneous ejection frequency of the ink droplets or the number of spontaneous ejections of the ink droplet per predetermined time; the ejecting conditions include at least one of a difference in electric potential between the ink ejecting means for ejecting the ink droplet, and a recording medium to which the ejected ink droplet is stuck and a counter electrode supporting the recording medium, a distance between the counter electrode and the ink ejecting means, and a temperature of the ink to be ejected, the distance and the ink temperature are set as an initial distance and an initial temperature, respectively, and the potential difference is increased or decreased from the initial potential difference to obtain an ejection potential difference and a non-ejection potential difference between which a critical potential difference as a critical value at which spontaneous ejection of the ink droplets occurs exists; a potential difference obtained by increasing the ejection potential difference or the critical potential difference is set as a detected potential difference; the spontaneous ejection frequency of the ink droplet or the number of spontaneous ejections of the ink droplet per predetermined time at the detected potential difference is detected; a detected value of the spontaneous ejection frequency or the number of spontaneous ejections is compared with a previously set desired value of the spontaneous ejection frequency or the number of spontaneous ejections; an operation is repeated in which when the detected value is smaller than the desired value, the potential difference is further increased from the detected potential difference, while when the detected value is larger than the desired value, the potential difference is further decreased from the detected potential difference to set a new detected potential difference, and in which the spontaneous ejection frequency or the number of spontaneous ejections at the detected potential difference thus set is detected to obtain the detected value; when the detected value coincides with the desired value or falls within a predetermined tolerance of the desired value, the detected electric potential, the distance, and the ink temperature at that time are set as a potential difference for drive, a distance for drive, and a temperature for drive, respectively; until the detected value coincides with the desired value or falls within a predetermined tolerance of the desired value, an operation is repeated in which when the detected value is smaller than the desired value even if the detected potential difference becomes a maximum allowable potential difference, the distance is shortened from the initial distance to update the initial distance, or the ink temperature is increased from the initial temperature to update the initial temperature, while when the detected value is larger than the desired value even if the detected potential difference becomes the maximum allowable potential difference, the distance is increased from the initial distance to update the initial distance, or the ink temperature is decreased from the initial temperature to update the initial temperature, the critical potential difference at the updated initial distance or the updated initial temperature is detected, and the detected value at the detected potential difference larger than the critical potential difference is detected, and the detected value is compared with the desired value, the detected potential difference, the distance, and the ink temperature at that time being set as the potential difference for drive, the distance for drive, and the temperature for drive, respectively; a potential difference smaller than the critical potential difference, or an electric potential equal to or smaller than the non-ejection potential difference is set as a bias potential difference to be applied across the ink ejecting means and the recording medium; and a difference between the potential difference for drive and the bias electric potential is set as a drive pulse potential difference.

In addition, preferably when the detected value is smaller or larger than the desired value even if the detected potential difference becomes a maximum allowable potential difference, first of all, the distance is decreased or increased from the initial distance to update the initial value; and when the detected value is still smaller than or larger than the desired value, the ink temperature is increased or decreased from the initial temperature to update the initial temperature.

Moreover, it is preferable that when the drive pulse potential difference is larger than a desired potential difference, a distance shorter than the distance for drive is set as the initial distance, or a temperature higher than the temperature for drive is set as the initial temperature, or both of those processing are executed, and updating of the detected potential difference, the potential difference for drive, the distance for drive, the temperature for drive, the bias potential difference, and the drive pulse potential difference is repeatedly carried out until the drive pulse potential difference becomes equal to or smaller than the desired potential difference.

In addition, it is preferable that a distance shorter than the distance for drive be firstly set as the initial distance, and when the drive pulse potential difference be still larger than the desired potential difference as a result of that setting, a temperature higher than the temperature for drive be set as the initial temperature.

It is needless to mention that, when an intermediate electrode is provided between the ejection electrode and the recording medium, and the ink droplets are ejected by utilizing a difference in electric potential between the intermediate electrode and the ejection electrode, of the ejecting conditions to be changed, a difference in electric potential between the ink ejecting means (ejection electrode) and the intermediate electrode is used instead of the potential difference applied across the recording medium and the ink ejecting means.

According to the present invention, since the spontaneous ejection property is detected and the ejecting conditions are adjusted in accordance with the detected spontaneous ejection property, the detected spontaneous ejection property can be fixed irrespective of the factors for changing the spontaneous ejection property. Thus, it becomes possible to stably record an image of high image quality for a long time.

DESCRIPTION OF THE PREFERRED EMBODIMENTS

An ink jet recording apparatus and a method of controlling the same according to the present invention will hereinafter be described in detail based on preferred embodiments of the present invention shown in the accompanying drawings.

Figure 1A:
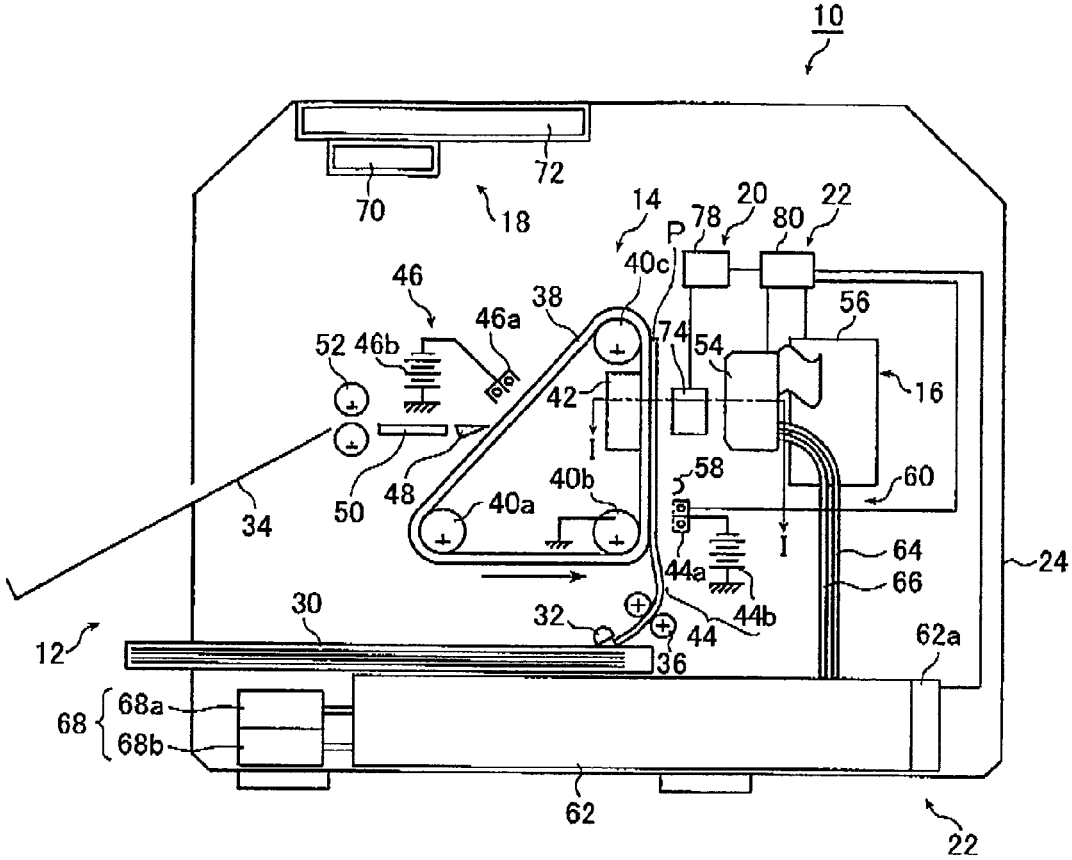
FIG. 1A is a schematic view showing an overall construction of an ink jet recording apparatus according to an embodiment of the present invention.
Figure 1B:
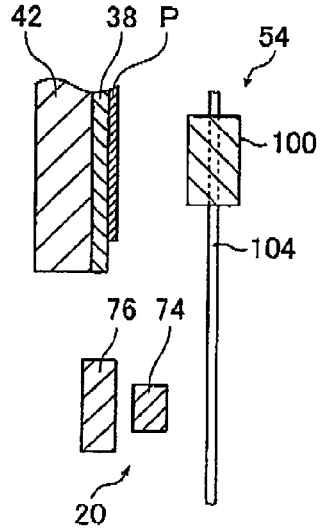
FIG. 1B is a cross-sectional view taken along a line I-I of FIG. 1A.

FIG. 1A is a schematic view showing an overall construction of an ink jet recording apparatus according to an embodiment of the present invention. FIG. 1B is a cross sectional view taken along the line I-I of FIG. 1A.

An ink jet recording apparatus 10 shown in FIG. 1A is an electrostatic type ink jet recording apparatus with which ejection of ink containing charged colorant particles is controlled by utilizing an electrostatic force to record a monochrome image on a recording medium P. The ink jet recording apparatus 10 includes means 12 for holding the recording medium P, conveyance means 14, recording means 16, solvent collection means 18, ejection property detecting means 20, ejecting condition control means 22 and a casing 24.

The means 12 for holding the recording medium P includes a sheet-feeding tray 30 for holding the recording medium P before the recording, a feed roller 32, and a sheet-discharging tray 34 for holding the recording medium P after completion of the recording.

A front end portion of the sheet feeding tray 30 is inserted into the inside of an installation portion for the sheet feeding tray 30 (provided on a lower portion on the left-hand side of the casing 24 in FIG. 1A). In this connection, the sheet-feeding tray 30 is detachably inserted into a predetermined position of the installation portion. In a state in which the sheet-feeding tray 30 is perfectly installed in the installation portion, the front end portion of the sheet feeding tray 30 in an insertion direction contacts an inner end portion of the installation portion, and a rear end portion of the sheet feeding tray 30 projects outwardly from the casing 24. In addition, the feed roller 32 is disposed in the vicinity of the inner end portion of the installation portion for the sheet-feeding tray 30.

A plurality of sheets of the recording medium P before the recording are stocked on top of one another within the sheet feeding tray 30. In recording an image, the sheets are taken out one by one from the sheet-feeding tray 30 by the feed roller 32 to be supplied to the conveyance means 14 for the recording medium P.

The discharge tray 34 is disposed in the vicinity of a discharge portion for the recording medium P (corresponding to a central portion on the left-hand side of the casing 24 in FIG. 1A) so that a front end portion side (toward which the recording medium P is conveyed) is located outside the casing 24, and a rear end portion thereof is located inside the casing 24. In addition, the discharge tray 34 is disposed at a predetermined inclination angle with respect to a horizontal line so that the front end portion thereof is lower in position than the rear end portion thereof.

The recording medium P after completion of the recording are conveyed by the conveyance means 14 to be discharged through the discharge portion, and are then successively stocked on top of one another within the discharge tray 34.

Subsequently, the conveyance means 14 for the recording medium P will be described.

The conveyance means 14 is means for electrostatically attracting the recording medium P to convey the recording medium P along a predetermined path from the sheet-feeding tray 30 to the discharge tray 34. The conveyance means 14 includes a conveyance roller pair 36, a conveyor belt 38, belt rollers 40*a*, 40*b*, and 40*c*, an electrically conductive platen 42, a charger 44 and a discharger 46 for the recording medium P, a separation claw 48, a guide 50, and a fixing roller pair 52.

The conveyance roller pair 36 is provided in a position between the feed roller 32 and the conveyor belt 38 on the conveyance path for the recording medium P.

The recording medium P taken out from the sheet feeding tray 30 by the feed roller 32 is held and conveyed by the conveyance roller pair 36 to be supplied to a predetermined position on the conveyor belt 38.

The charger 44 for the recording medium P includes a scorotron charger 44*a* and a negative high voltage power source 44*b*. The scorotron charger 44*a* is disposed in a position between the conveyance roller pair 36 and the recording means 16 along the conveyance path for the recording medium P, i.e., in a position where the charger 44*a* is opposed to the surface of the conveyor belt 38 on which the recording medium P is supplied by the conveyance roller pair 36. In addition, a negative side terminal of the negative high voltage power source 44*b* is connected to the scorotron charger 44*a*, and a positive side terminal of the negative high voltage power source 44*b* is grounded.

The surface of the recording medium P is uniformly charged to a predetermined negative high voltage by the scorotron charger 44*a* connected to the negative high voltage power source 44*b*, and thus is in a state of being always biased at a given D.C. bias voltage (e.g., about −1.5 kV). As a result, the recording medium P is electrostatically attracted to the surface of the conveyor belt 38 having an insulation property.

The conveyor belt 38 is a ring-shaped endless belt, and is stretched in a triangular shape around the three belt rollers 40*a*, 40*b*, and 40*c*. In addition, the flat plate-like conductive platen 42 is disposed in an inner portion of the conveyor belt 38 in a position corresponding to the recording means 16.

A face of the conveyor belt, 38 to which the recording medium P is to be electrostatically attracted (front side) has the insulation property, and a face of the conveyor belt 38 adapted to contact the belt rollers 40*a*, 40*b*, and 40*c* (rear side) has the conduction property. The belt roller 40*b* is grounded, and hence the belt rollers 40*a* and 40*c*, and the conductive platen 42 are also grounded through the rear surface of the conveyor belt 38. As a result, a portion of the conveyor belt 38 in a position where the belt 38 faces the recording means 16 functions as a counter electrode of the ink jet head to be described later.

At least one of the belt rollers 40*a*, 40*b*, and 40*c* is connected to a drive source (not shown), and is driven and rotated at a predetermined speed during the recording. As a result, during the recording, the conveyor belt 38 is moved in a direction indicated by an arrow in FIG. 1A. Consequently, as the conveyor belt 38 moves, the recording medium P is conveyed while the recording medium P faces the recording means 16.

The discharger 46 for the recording medium P includes a corotron discharger 46*a* and a high voltage power source 46*b*. The corotron discharger 46*a* is disposed in a position between the recording means 16 and the separation claw 48 along the conveyance path for the recording medium P, i.e., in a position where the discharger 46*a* is opposed to the surface of the conveyor belt 38 on which the recording medium P after completion of the recording is conveyed. In addition, one terminal of the high voltage power source 46*b* is connected to the corotron discharger 46*a*, and the other terminal of the high voltage power source 46*b* is grounded.

The electric charges on the recording medium P after completion of the recording are discharged by the corotron discharger 46*a* connected to the high voltage power source 46*b*. As a result, the recording medium P becomes easy to be separated from the conveyor belt 38.

In addition, the separation claw 48, the guide 50, and the fixing roller pair 52 are disposed in this order on a downstream side of the discharger 46 along the conveyance path for the recording medium P.

The recording medium P the electric charges on which have been discharged by the discharger 46 is separated from the conveyor belt 38 by the separation claw 48 to be supplied to the fixing roller pair 52 along the guide 50. The fixing roller pair 52 is a pair of rollers including a heat roller. An image recorded on the recording medium P is fixed through the contact and the heating while the recording medium P is held and conveyed by the fixing roller pair 52. The recording medium P after completion of the fixation is discharged through the discharge portion to be successively stacked on top of one another within the discharge tray 34.

Subsequently, the recording means 16 for the recording medium P will be described.

The recording means 16 is used to record a monochrome image on the recording medium P with the electrostatic force. The recording means 16 includes a head unit 54, a head driver 56, a position detector 58 for the recording medium P and an ink circulation system 60.

The head unit 54 is disposed at a predetermined distance away from the surface of the conveyor belt 38 so that the head unit 54 is opposed to the surface of the conveyor belt 38 in a position where the conductive platen 42 is disposed. While details will be described later, the head unit 54 of this embodiment includes a recording head 106 (see FIG. 2) for ejecting ink droplets to record an image on the surface of the recording medium P, and thus records an image on the surface of the recording medium P by performing the serial scanning in which it is repeated that the ink droplets are ejected while the main scanning with the recording head 106 is carried out for the recording medium P in a direction perpendicular to a direction of conveyance of the recording medium P, and the recording medium P is then intermittently conveyed by only a fixed amount.

An example of the head unit 54 used in this embodiment will hereinafter be described with reference to FIG. 2.

Figure 2:
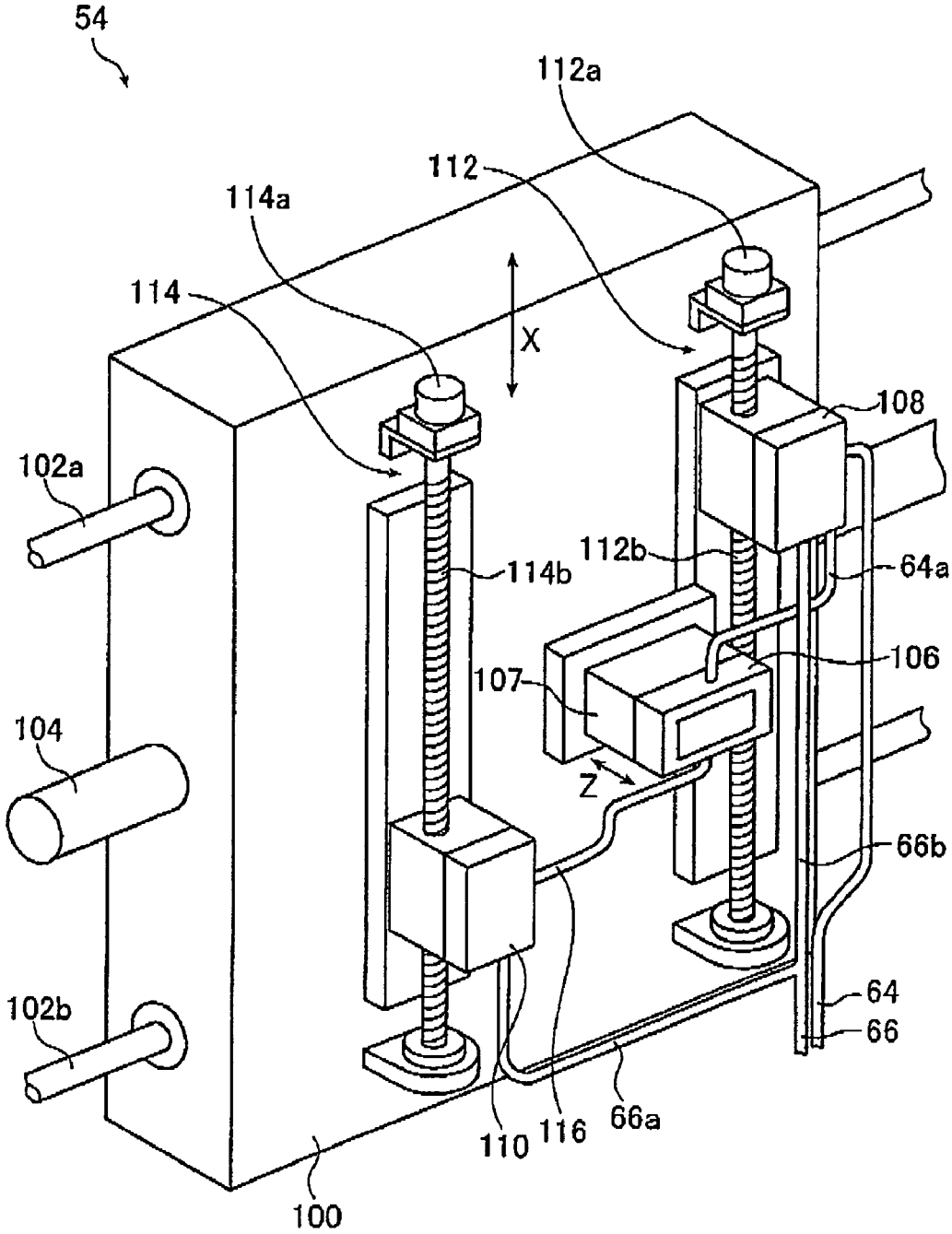
FIG. 2 is an enlarged perspective view showing a head unit shown in FIG. 1A.

FIG. 2 is an enlarged perspective view showing a construction of the head unit 54. In FIG. 2, a direction indicated by an arrow X is the direction of conveyance of the recording medium P by the conveyor belt 38.

The head unit 54 includes a support member 100, guide rails 102*a* and 102*b*, drive means 104, the recording head 106, a position adjustor 107 for the recording head 106, an ink supply sub-tank 108, an ink recovery sub-tank 110, and a sub-tank position adjusting mechanism (including a portion 112 on a side of the supply sub-tank 108 and a portion 114 on a side of the recovery sub-tank 110).

The guide rails 102*a* and 102*b* are disposed at a predetermined distance away from each other, and are also disposed along a direction perpendicular to the direction of movement of the conveyor belt 38 (the direction indicated by the arrow X).

The drive means 104 is comprised of a ball screw and the like adapted to be driven by a motor (not shown), and is disposed between the guide rails 102*a* and 102*b* so as to be parallel with the guide rails 102*a* and 102*b*.

The support member 100 is supported by the guide rails 102*a* and 102*b* and the drive means 104, and is adapted to be moved by the drive means 104 in the direction perpendicular to the direction of movement of the conveyor belt 38 (the direction indicated by the arrow X) along the guide rails 102*a* and 102*b*. In addition, the support member 100 has a plate-like shape. The position adjustor 107, the recording head 106, the ink supply sub-tank 108, the ink recovery sub-tank 110, and the sub-tank position adjusting mechanism (including the portion 112 on the side of the supply sub-tank 108 and the portion 114 on the side of the recovery sub-tank 110) are disposed on the support member 100.

The recording head 106 is fixed on the support member 100 through the position adjustor 107, and includes a monochrome ink jet head for recording a monochrome image using black (K) ink for example. The ink jet head used in the recording head 106 will be described in detail later.

The position adjustor 107 is used to adjust the distance between the recording head 106 and the recording medium P or the surface of the conveyor belt 38 supporting the recording medium P and functioning as the counter electrode by moving the recording head 106 in directions indicated by an arrow Z in FIG. 2 and perpendicular to the surface of the support member 100. Any known unidirectional position adjusting mechanism can be used as the position adjusting mechanism applied to the position adjustor 107. Although not shown, a combination of unidirectional moving means such as a linear guide, a helical ring guide or a ball screw and a drive source such as a servomotor or a stepping motor can be used for instance. The position adjusting mechanism is preferably provided with a drive source but may be of a manual type.

The sub-tank position adjusting mechanism (including the portion 112 on the side of the supply sub-tank 108 and the portion 114 on the side of the recovery sub-tank 110) disposed on the support member 100 includes motors 112*a* and 114*a*, and ball screws 112*b* and 114*b*. The ball screws 112*b* and 114*b* are disposed along the direction indicated by the arrow X in order to support the supply sub-tank 108 and the recovery sub-tank 110, respectively.

The sub-tank position adjusting mechanisms 112 and 114 are adapted to drive the ball screws 112*b* and 114*b* using the motors 112*a* and 114*a* to move the ink supply sub-tank 108 and the ink recovery sub-tank 110 in the directions indicated by the arrow X, respectively, thereby adjusting the positions of the ink supply sub-tank 108 and the ink recovery sub-tank 110.

Here, the sub-tank position adjusting mechanism is not intended to be limited to the above-mentioned construction, and various other position adjusting mechanisms can be utilized for the sub-tank position adjusting mechanisms 112 and 114. In addition, since the positions of the ink supply sub-tank 108 and the ink recovery sub-tank 110 are not frequently changed, there may also be adopted such a construction that the positions of the ink supply sub-tank 108 and the ink recovery sub-tank 110 are manually adjusted.

The ink supply sub-tank 108 is connected to an ink tank 62 (refer to FIG. 1A) of the ink circulation system 60 which will be described later through an ink supply passage 64, and is adapted to supply the ink from the ink tank 62 to the recording head 106 through an ink supply passage 64*a*.

Here, the ink which is excessively supplied to the ink supply sub-tank 108 is caused to flow through the ink recovery passage 66*b* by utilizing a hydrostatic pressure to be recovered into the ink tank 62. As a result, the amount of ink collected in the ink supply sub-tank 108 is kept constant.

The recording head 106 records an image using the ink supplied thereto, and the ink which has not been used in the recording head 106 is recovered into the ink recovery sub-tank 110 through an ink-flow-path 116.

The ink recovery sub-tank 110 is connected to the ink tank 62 through the ink recovery passages 66*a* and 66. Thus, the ink recovered into the ink recovery sub-tank 110 is then recovered into the ink tank 62. Here, the ink recovery sub-tank 110 is adapted to keep the surface of the ink at a fixed level by utilizing the hydrostatic pressure as in the case of the ink supply sub-tank 108.

Thus, since the surfaces of the ink in the ink supply sub-tank 108 and the ink recovery sub-tank 110 are kept at the fixed levels, respectively, the pressure of the ink applied to the recording head 106 becomes constant.

As described above, the head unit 54 carries out the recording by performing the serial scanning in which it is repeated that the ink is ejected along the guide rails 102*a* and 102*b* while the main scanning with the recording head 106 (the support member 100) is carried out in the direction perpendicular to the direction of conveyance of the recording medium P, and the recording medium P is then conveyed by a fixed amount.

Here, a concrete example of an electrostatic ink jet head 120 used in the recording head 106 of this embodiment for ejecting ink containing charged colorant particles are shown in FIGS. 3, 4A and 4B, and 5A to 5C.

Figure 3:
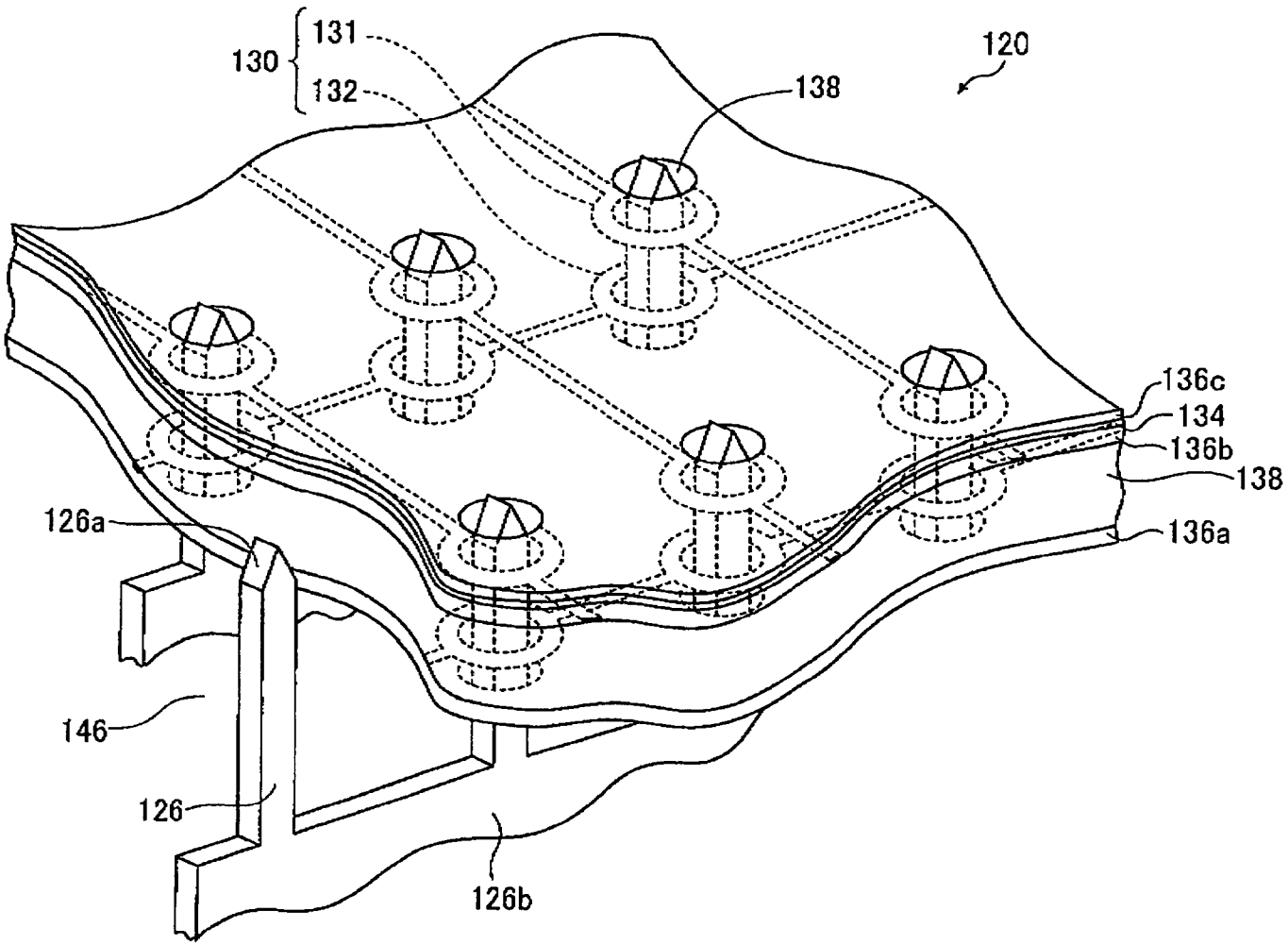
FIG. 3 is a schematic view showing a construction of an electrostatic ink jet head as an embodiment of a recording head shown in FIG. 2.
Figure 4A:
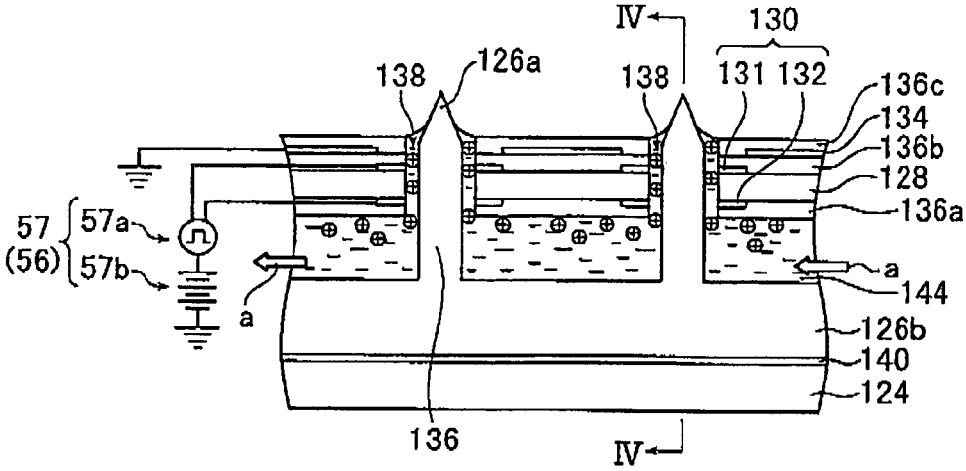
FIG. 4A is a schematic cross-sectional view showing a construction of an ink jet head shown in FIG. 3.

FIG. 3 is a partial perspective view schematically showing a construction of an example of the ink jet head 120 used in the recording head 106 shown in FIG. 2. FIG. 4A is a schematic cross-sectional view showing a part of the ink jet head 120 shown in FIG. 3. FIG. 48 is a schematic cross-sectional view taken along line IV-IV in FIG. 4A. FIGS. 5A, 5B, and 5C are arrow views each taken along the line A-A, the line B-B, and the line C-C in FIG. 4B (through hole portions are viewed from upper side).

The ink jet head 120 shown in these figures is an electrostatic ink jet head having ejection electrodes of a two-layered electrode structure and records an image corresponding to image data on the recording medium P by ejecting ink Q containing colorant particles, such as charged pigments (fine particle component of toner or the like, for instance), by means of an electrostatic force. For this purpose, the ink jet head 120 includes a head substrate 124, ink guides 126, an insulative substrate 128, first ejection electrodes 131 and second ejection electrodes 132 constituting ejection electrodes 130, and a floating conduction plate 140. The ink jet head 120 having this construction is arranged so as to be opposed to the conveyor belt 38 (see FIG. 1A) that supports the recording medium P and serves as a counter electrode.

In the ink jet head 120 of the illustrated example, the ejection electrodes 130 form a two-layered electrode structure where the insulative substrate 128 is sandwiched between the first ejection electrodes 131 arranged on the upper surface of the insulative substrate 128 and the second ejection electrodes 132 arranged on the lower surface thereof in the figures. Then, the ejection electrodes 130 are connected to a voltage control portion 57*a* and a high voltage source 57*b* constituting a signal voltage source 57 for the head driver 56 which will be described later so that a predetermined drive voltage for allowing the ink droplets to be ejected, i.e., a predetermined drive voltage for allowing the ink droplets to be spontaneously ejected at a proper frequency (in an image recording mode, a predetermined drive pulse voltage (having a high level of 400 to 600 V and a low level of 0 V for example), and in the mode for detecting the spontaneous ejection property of the ink droplets, a predetermined constant D.C. voltage (in a range of 400 to 600 V for example)) are applied to the ejection electrodes 130 (see FIGS. 4A and 4B).

The ink jet head 120 of the illustrated example also includes an insulation layer 136*a* covering the lower side (lower surfaces) of the second ejection electrodes 132, an insulation layer 136*b* covering the upper side (upper surfaces) of the first ejection electrodes 131, a sheet-like guard electrode 134 arranged on the upper side of the first ejection electrodes 131 with the insulation layer 136*b* in-between, and an insulation layer 136*c* covering the upper surface of the guard electrode 134.

In the ink jet head 120 of the illustrate example, each ink guide 126 is made of an insulative resin flat plate having a predetermined thickness and having a projection-like tip end portion 126*a*, and each ink guide 126 is arranged on the head substrate 124 at the position of each ejection portion. Further, in a layered product of the insulation layer 136*a*, the insulative substrate 128, and the insulation layers 136*b* and 136*c*, through holes 138 are established at positions corresponding to the arrangement of the ink guides 126. The ink guides 126 are inserted into the through holes 138 from the insulation layer 136*a* side so that the tip end portions 126*a* of the ink guides 126 project from the insulation layer 136*c*. Note that a slit serving as an ink guide groove may be formed in the tip end portion 126*a* of each ink guide 126 in the top-bottom direction on the paper plane of FIG. 4A, thereby promoting supply of the ink Q and concentration of the colorant particles in the ink Q in the tip end portion 126*a*.

The tip end portion 126*a* of each ink guide 126 is formed in an approximately triangular shape (or an approximately trapezoidal shape) that is gradually narrowed toward the recording medium P (conveyor belt 38) side. Also, it is preferable that a metal be vapor-deposited on the tip end portion (extreme tip end portion) 126*a* of each ink guide 126 from which the ink Q is to be ejected. Although there occurs no problem even if the metal vapor-deposition is not carried out for the tip end portion 126*a* of the ink guide 126, it is preferable that the metal vapor-deposition be conducted because the effective dielectric constant of the tip end portion 126*a* of the ink guide 126 becomes large as a result of the metal vapor-deposition and there is provided an effect that it becomes easy to generate an intense electric field. Note that the shape of the ink guides 126 is not specifically limited so long as it is possible to concentrate the ink Q (in particular, the colorant particles in the ink Q) in the tip end portions 126*a* through the through holes 138 of the insulative substrate 128. For instance, the shape of the tip end portions 126*a* may be changed as appropriate into a shape other than the projection, such as a conventionally known shape.

The head substrate 124 and the insulation layer 136*a* are arranged so as to be spaced apart from each other by a predetermined distance, and an ink flow path 144 functioning as an ink reservoir (ink chamber) for supplying the ink Q to the ink guides 126 is formed between the head substrate 124 and the insulation layer 136*a*. Note that the ink Q in the ink flow path 144 contains colorant particles charged to the same polarity as the voltages applied to the first ejection electrodes 131 and the second ejection electrodes 132, and is circulated in a predetermined direction (in the example shown in FIG. 4A, in the direction of an arrow "a" from the right to the left) in the ink flow path 144 at a predetermined speed (ink flow of 200 mm/s, for instance) by the ink circulation system 60 (see FIG. 1A) at the time of recording. Hereinafter, a case where the colorant particles in the ink are positively charged will be described as an example.

As shown in FIG. 3, the first ejection electrodes 131 and the second ejection electrodes 132 are arranged in a ring shape on the upper surface of the insulative substrate 128 (on the recording medium P side) and the lower surface thereof (on the head substrate 124 side), respectively, and they are circular electrodes surrounding the through holes 138 bored in the insulative substrate 128. Note that the first ejection electrodes 131 and the second ejection electrodes 132 are not limited to the circular electrodes and may be changed into approximately circular electrodes, division-circular electrodes, parallel electrodes, or approximately parallel electrodes. The first ejection electrodes 131 and the second ejection electrodes 132 are arranged in a matrix shape and form the two-layered electrode structure. Here, the multiple first ejection electrodes 131 are connected to each other in a row direction (main scanning direction, for instance) and the multiple second ejection electrodes 132 are connected to each other in a column direction (sub scanning direction, for instance).

When the first ejection electrodes 131 in one row are set at a high-voltage level or under a floating (high-impedance) state and the second ejection electrodes 132 in one column are set at a high-voltage level, that is, when both of one row and one column of the electrodes are set under an on-state, one ejection portion existing at an intersection of the row and the column is set under an on-state and ejects the ink. Note that ink ejection is not performed when one of the first ejection electrodes 131 and the second ejection electrodes 132 are set at a ground level. In this manner, the first ejection electrodes 131 and the second ejection electrodes 132 arranged in a matrix manner are matrix-driven.

Meanwhile, the recording medium P charged to a bias voltage having a polarity that is opposite to the polarity of the charged colorant particles in the ink is arranged so as to be opposed to the ink guides 126 while being held on the conveyor belt 38. As described above, in this embodiment, the recording medium P is charged to a negative high voltage. Also, the front surface of the conveyor belt 38 holding the recording medium P is an insulative fluororesin surface and the back surface thereof is a conductive metallic surface, with the metallic surface being grounded through the conductive belt roller 40*b* (see FIG. 1A).

The floating conduction plate 140 is arranged below the ink flow path 144 and is set under an electrically insulated state (high-impedance state). In the illustrated example, the floating conduction plate 140 is arranged on the upper surface of the head substrate 124.

At the time of recording of an image, the floating conduction plate 140 generates an induced voltage in accordance with the value of a voltage applied to each ejection portion and causes the colorant particles in the ink Q in the ink flow path 144 to migrate to the insulative substrate 128 side and to be concentrated in the ink Q. Accordingly, it is required that the floating conduction plate 140 is arranged on the head substrate 124 side with respect to the ink flow path 144. Also, it is preferable that the floating conduction plate 140 be arranged on an upstream side of the ink flow path 144 with respect to the position of the ejection portion. With this floating conduction plate 140, the concentration of the colorant particles in the upper layer in the ink flow path 144 is increased. As a result, it becomes possible to increase the concentration of the colorant particles in the ink 0 passing through the through holes 138 formed in the insulative substrate 128 to a predetermined level, to cause the colorant particles to be concentrated in the tip end portions 126*a* of the ink guides 126, and to maintain the concentration of the colorant particles in the ink Q ejected as ink droplets at a predetermined level.

In the ink jet head 120 of this embodiment including the ejection electrodes 130 of the two-layered electrode structure described above, the second ejection electrodes 132 always receive application of a predetermined voltage (600 V, for instance) and the first ejection electrodes 131 are switched between a ground state (off-state) and a high-impedance state (on-state) in accordance with image data, for instance. By doing so, ejection/non-ejection of the ink Q containing the colorant particles charged to the same polarity as that of the high-voltage applied to the second ejection electrodes 132 is controlled. That is, in the ink jet head 120, when one of the first ejection electrodes 131 is set at the ground level (off-state), the electric field strength in the vicinity of the tip end portion 126*a* of a corresponding ink guide 126 remains low and ejection of the ink Q from the tip end portion 126*a* of the ink guide 126 is not performed. On the other hand, when one of the first ejection electrodes 131 is set under the high-impedance state (on-state), the electric field strength in the vicinity of the tip end portion 126*a* of the corresponding ink guide 126 is increased and the ink Q concentrated in the tip end portion 126*a* of the ink guide 126 is ejected from the tip end portion 126*a* by means of an electrostatic force. When doing so, it is also possible to further concentrate the ink Q by selecting the condition.

In such a two-layered electrode structure, the first ejection electrodes 131 are switched between the high-impedance state and the ground level, so that no large electric power is consumed for the switching. Therefore, according to this embodiment, even in the case of an ink jet head that needs to perform high-definition recording at a high speed, it becomes possible to significantly reduce power consumption.

It should be noted here that the ejection/non-ejection may be controlled by switching the first ejection electrodes 131 between the ground level (off-state) and the high-voltage level (on-state) in accordance with image data. In the ink jet head 120 of this embodiment, when one of the first ejection electrodes 131 and the second ejection electrodes 132 are set at the ground level, the ink ejection is not performed and, only when the first ejection electrodes 131 are set under the high-impedance state or at the high-voltage level and the second ejection electrodes 132 are set at the high-voltage level, the ink ejection is performed.

Also, in this embodiment, pulse voltages may be applied to the first ejection electrodes 131 and the second ejection electrodes 132 in accordance with image signals and the ink ejection may be performed when both of these electrodes are set at the high-voltage level.

It should be noted here that it does not matter whether the ink ejection/non-ejection is controlled using one or both of the first ejection electrodes 131 and the second ejection electrodes 132. However, it is preferable that when one of the first ejection electrodes 131 and the second ejection electrodes 132 are set at the ground level, no ejection of the ink Q be performed and, only when the first ejection electrodes 131 are set under the high-impedance state or at the high-voltage level and the second ejection electrodes 132 are set at the high-voltage level, ink ejection be performed.

Also, the recording medium P may be charged to −1.5 kV, for instance, and the ink ejection may be controlled so that the ink will not be ejected when at least one of the first ejection electrodes 131 and the second ejection electrodes 132 are set at a negative high voltage (−600 V, for instance) and the ink will be ejected only when both of the first ejection electrodes 131 and the second ejection electrodes 132 are set at the ground level (0 V).

Also, according to this embodiment, the ejection portions are arranged in a two-dimensional manner and are matrix-driven, so that it becomes possible to significantly reduce the number of row drivers for driving multiple ejection portions in the row direction and the number of column drivers for driving multiple ejection portions in the column direction. Therefore, according to this embodiment, it becomes possible to significantly reduce the implementation area and power consumption of a circuit for driving the two-dimensionally arranged ejection portions. Also, according to this embodiment, it is possible to arrange the ejection portions while maintaining relatively large margins, so that it becomes possible to extremely reduce a danger of discharging between the ejection portions and to cope with both of high-density implementation and high voltage driving with safety.

It should be noted here that in the case of an ink jet head, such as the electrostatic ink jet head 120 described above, that uses the ejection electrodes 130 of the two-layered electrode structure composed of the first ejection electrodes 131 and the second ejection electrodes 132, when the ejection portions ate arranged at a high density, an electric field interference may occur between adjacent ejection portions. Therefore, it is preferable that, like in this embodiment, the guard electrode 134 be provided between the first ejection electrodes 131 of adjacent ejection portions so that the guard electrode 134 may shield the ink guides 126 from the electric lines of force to the adjacent ink guides 126.

The guard electrode 134 is arranged in spaces between the first ejection electrodes 131 of adjacent ejection portions and suppresses the electric field interferences generated between the ink guides 126 of the adjacent ejection portions. FIG. 5A, 5B, and SC are respectively arrow views taken along the lines A-A, B-B, and C-C in FIG. 4B. As shown in FIG. 5A, the guard electrode 134 is a sheet-like electrode such as a metal plate that is common to every ejection portion, and holes are bored in the guard electrode 134 in portions corresponding to the first ejection electrodes 131 (respective ejection portions two-dimensionally arranged) formed around the through holes 138 (also see FIG. 3). Note that in this embodiment, the reason why the guard electrode 134 is provided is that if the ejection portions are arranged at a high density, there is a case where an electric field generated by an ejection portion is influenced by the states of electric fields generated by its adjacent ejection portions and therefore the size and drawing position of a dot ejected from the ejection portion fluctuate and recording quality is adversely affected.

Figure 4B:
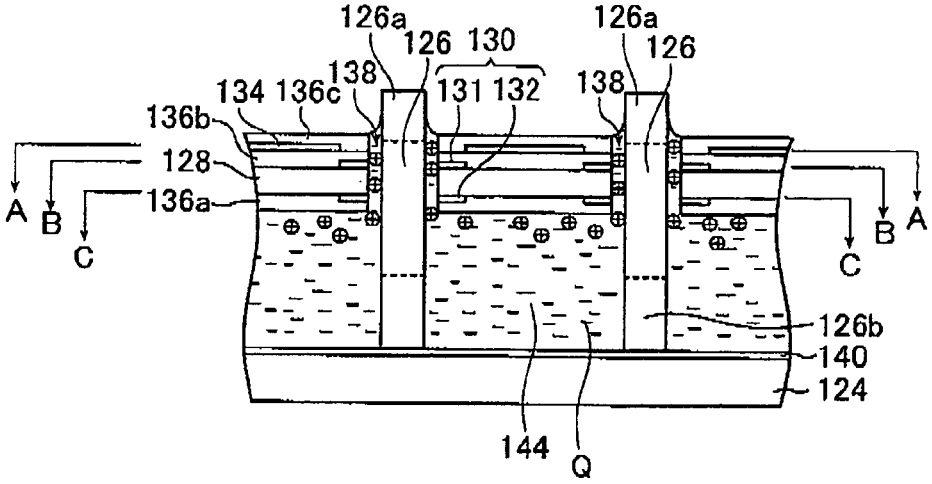
FIG. 4B is a schematic cross-sectional view taken along a line IV-IV of FIG. 4A.
Figure 5A:
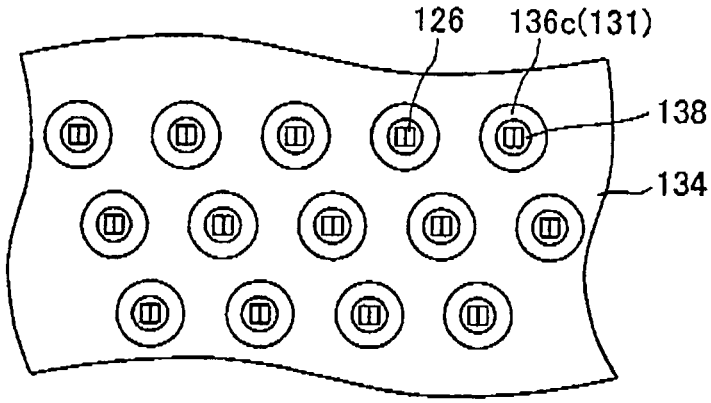
FIGS. 5A, 5B, and 5C are views as seen in the direction of line A-A, line B-B, and line C-C of FIG. 4B.
Figure 5B:
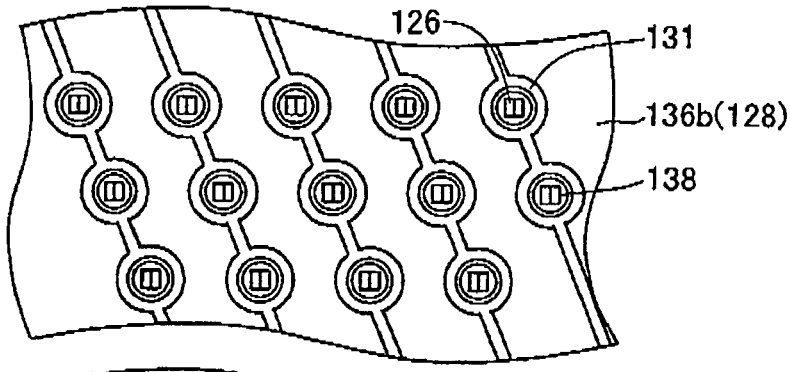
Figure 5C:
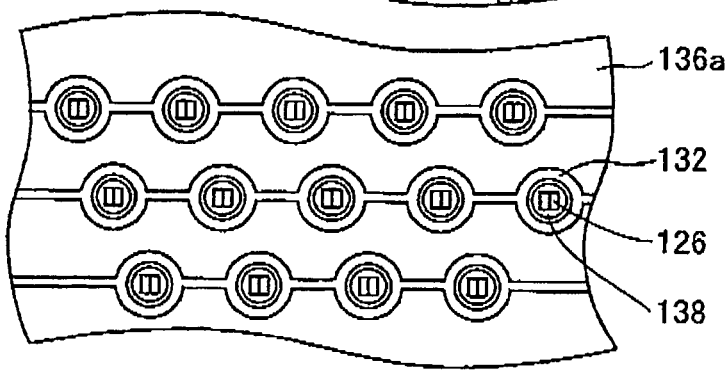

By the way, the upper side of the guard electrode 134 shown in FIGS. 4A and 4B is covered with the insulation layer 136*c* except the through holes 138 and the insulation layer 136*b* is disposed between the guard electrode 134 and the first ejection electrodes 131, thereby insulating the electrodes 134 and 131 from each other. That is, the guard electrode 134 is arranged between the insulation layer 136*c* and the insulation layer 136*b* and the first ejection electrodes 131 are arranged between the insulation layer 136*b* and the insulative substrate 128.

That is, as shown in FIG. 5B, on the upper surface of the insulative substrate 128, that is, between the insulation layer 136*b* and the insulative substrate 128, the first ejection electrodes 131 of the respective ejection portions formed around the through holes 138 are two-dimensionally arranged and are connected to each other in the column direction.

Also, as shown in FIG. 5C, on the upper surface of the insulation layer 136*a* (that is, on the lower surface of the insulative substrate 128), that is, between the insulation layer 136*a* and the insulative substrate 128 (see FIG. 3), the second ejection electrodes 132 of the respective ejection portions formed around the through holes 138 are two-dimensionally arranged and are connected to each other in the row direction.

Also, in this embodiment, in order to shield from a repulsive electric field from the ejection electrode 130 of each ejection portion (a repulsive electric field from each first ejection electrode 131 and each second ejection electrode 132) toward the ink flow path 144, a shield electrode may be provided on the flow path side of the second ejection electrode 132.

Further, in the ink jet head 120 of this embodiment, the floating conduction plate 140 is provided which constitutes the undersurface of the ink flow path 144 and causes the positively charged colorant particles (charged colorant particles) in the ink flow path 144 to migrate upwardly (that is, toward the recording medium P side) by means of induced voltages generated by pulse voltages applied to the first ejection electrodes 131 and the second ejection electrodes 132. Also, an electrically insulative coating film (not shown) is formed on a surface of the floating conduction plate 140, thereby preventing a situation where the physical properties and components of the ink are destabilized due to charge injection into the ink or the like. It is preferable that the electric resistance of the insulative coating film be set at $10^{12}$ Ω·cm or higher, more preferably at $10^{13}$ Ω·cm or higher. Also, it is preferable that the insulative coating film be corrosion resistant to the ink, thereby preventing a situation where the floating conduction plate 140 is corroded by the ink. Further, the floating conduction plate 140 is covered with an insulation member from its bottom side. With this construction, the floating conduction plate 140 is completely electrically insulated and floated.

Here, at least one floating conduction plate 140 is provided for each unit of the ink jet head. A monochrome ink jet head is used in this embodiment, but when four ink jet heads are used for C, M, Y, and K, each head is provided with at least one floating conduction plate 140 and the ejection heads for C and M will never share the same floating conduction plate.

In this embodiment, the circular electrodes are provided as the first ejection electrodes 131 and the second ejection electrodes 132 of the respective ejection portions and these electrodes are connected to each other in the row direction and the column direction. However, the present invention is not limited to this and all of the ejection portions may be separated from each other and driven independently of each other. Alternatively, one of the first ejection electrodes 131 and the second ejection electrodes 132 may be set as a sheet-like electrode common to every ejection portion (holes are bored in portions corresponding to the through holes 138).

Also, in this embodiment, the ejection electrodes are arranged so as to form the two-layered electrode structure composed of the first ejection electrodes 131 and the second ejection electrodes 132. However, the present invention is not limited to this and the ejection electrodes may be arranged so as to form a mono-layered electrode structure. In the case of the mono-layered electrode structure, it does not matter on which surface of the insulative substrate 128 the ejection electrodes are arranged, although it is preferable that the ejection electrodes be provided on the recording medium P side thereof. The ink jet head is constructed as described above.

In addition, as described above, there is carried out the serial scanning in which it is repeated that the ink is ejected while the main scanning with the recording head 106 is carried out in the direction perpendicular to the direction of conveyance of the recording medium P, and the recording medium P is then conveyed by a fixed amount. Hence, the ejection portions of the ink jet head 120 are preferably disposed in a direction nearly parallel to the direction of conveyance of the recording medium P.

In addition, preferably, the ejection portions of the ink jet head 120 are disposed so as to be opposed to the surface of the conveyor belt 38 (see FIG. 1A) in a position where the conductive platen 42 is disposed and the ejection portions are at a predetermined distance away from the surface of the recording medium P which is conveyed with the recording medium P being electrostatically attracted to the conveyor belt 38.

As described above, the surface of the recording medium P which is electrostatically attracted to the conveyor belt 38 acting as the counter electrode is uniformly charged to a predetermined negative high potential by the charger 44 for the recording medium P, and hence is in a state in which a constant D.C. bias voltage (about −1.5 kV) is always applied thereto. In addition, in recording of an image, the pulse voltages corresponding to the image data are applied to the first and second ejection electrodes 131 and 132 of each of the ejection portions of the ink jet head 120 by a pulse voltage applying device (not shown) for application of pulse voltages to the ink jet head 120.

When the high voltages (400 to 600 V) are applied as the pulse voltages to the first and second ejection electrodes 131 and 132 of each of the ejection portions of the ink jet head 120, respectively, in a state in which the constant D.C. bias voltage (about −1.5 kV) is applied to the surface of the recording medium P, the ink is ejected, while when the low voltages (0 V) are applied as the pulse voltages to the first and second ejection electrodes 131 and 132 of each of the ejection portions of the ink jet head 120, respectively, no ink is ejected in that state. The ink ejected from the ink jet head 120 is attracted towards the surface of the recording medium P having the bias voltage applied thereto and adheres to the surface of the recording medium P, thereby recording a monochrome image corresponding to the image data on the surface of the recording medium P.

Note that, in this embodiment, the constant D.C. bias voltage is always applied to the surface of the recording medium P which is electrostatically attracted to the conveyor belt 38 acting as the counter electrode, and in recording of an image, the pulse voltages corresponding to the image data are applied to the first and second ejection electrodes 131 and 132, respectively. However, it may also be adapted that the counter electrode side is grounded, and in this state, a constant D.C. bias voltage (e.g., 1.5 kV) is always applied to the side of the first and second ejection electrodes 131 and 132 of each of the ejection portions of the ink jet head 120 by a D.C. bias voltage applying device (not shown) for application of a bias voltage to the ink jet head 120.

As described above, ink Q (ink composition) used in the present invention is obtained by dispersing colorant particles (charged fine particles which contain colorants) in a carrier liquid.

In addition, dispersion resin particles for enhancement of the fixing property of an image after completion of the printing may be contained together with the colorant particles in the ink Q.

The ink Q (ink composition) which is ejected by the ink jet head 120 is obtained by dispersing color particles (charged fine particles which contain colorants) in a carrier liquid.

The carrier liquid is preferably a dielectric liquid (non-aqueous solvent) having a high electrical resistivity (equal to or larger than $10^9$ Ω·cm, and more preferably equal to or larger than $10^{10}$ Ω·cm). If the electrical resistance of the carrier liquid is low, the concentration of the colorant particles does not occur since the carrier liquid receives the injection of the electric charges and is charged due to a drive voltage applied to the ejection electrodes. In addition, since there is also anxiety that the carrier liquid having a low electrical resistivity causes the electrical conduction between the adjacent ejection electrodes, the carrier liquid having a low electrical resistivity is unsuitable for the present invention.

The relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby the electric field effectively acts on the colorant particles contained in the carrier liquid to facilitate the electrophoresis of the colorant particles.

Note that the upper limit of the specific electrical resistance of such a carrier liquid is desirably about $10^{16}$ Ω·cm, and the lower limit of the relative permittivity is desirably about 1.9. The reason why the electrical resistance of the carrier liquid preferably falls within the above-mentioned range is that if the electrical resistance becomes low, then the ejection of the ink under a low electric field becomes worse. Also, the reason why the relative permittivity preferably falls within the above-mentioned range is that if the relative permittivity becomes high, then the electric field is relaxed due to the polarization of the solvent, and as a result the color of dots formed under this condition becomes light, or the bleeding occurs.

Preferred examples of the dielectric liquid used as a carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent, (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such colorant particles dispersed in the carrier liquid, colorants themselves may be dispersed as the colorant particles into the carrier liquid, but dispersion resin particles are preferably contained for enhancement of fixing property. In the case where the dispersion resin particles are contained in the carrier liquid, in general, there is adopted a method in which pigments are covered with the resin material of the dispersion resin particles to obtain particles covered with the resin, or the dispersion resin particles are colored with dyes to obtain the colored particles.

As the colorants, pigments and dyes conventionally used in ink compositions for ink jet recording, (oily) ink compositions for printing, or liquid developers for electrostatic photography may be used.

Pigments used as colorants may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

Further, examples of dispersion resin particles include rosins, rosin-modified phenol resin, alkyd resin, a (meta)acryl polymer, polyurethane, polyester, polyamide, polyethylene, polybutadiene, polystyrene, polyvinyl acetate, acetal-modified polyvinyl alcohol, and polycarbonate.

Of those, from the viewpoint of ease for particle formation, a polymer having a weight average molecular weight in a range of 2,000 to 1,000,000 and a polydispersity (weight average molecular weight/number average molecular weight) in a range of 1.0 to 5.0 is preferred. Moreover, from the viewpoint of ease for the fixation, a polymer in which one of a softening point, a glass transition point, and a melting point is in a range of 40° C. to 120° C. is preferred.

In the ink Q, the content of colorant particles (total content of colorant particles and dispersion resin particles) preferably falls within a range of 0.5 to 30.0 wt % for the overall ink, more preferably falls within a range of 1.5 to 25.0 wt %, and much more preferably falls within a range of 3.0 to 20.0 wt %. If the content of colorant particles decreases, the following problems become easy to arise. The density of the printed image is insufficient, the affinity between the ink Q and the surface of the recording medium P becomes difficult to obtain to prevent the image firmly stuck to the surface of the recording medium P from being obtained, and so forth. On the other hand, if the content of colorant particles increases, problems occur in that the uniform dispersion liquid becomes difficult to obtain, the clogging of the ink Q is easy to occur in the ink jet head 120 or the like to make it difficult to obtain the stable ink ejection, and so forth.

In addition, the average particle diameter of the colorant particles dispersed in the carrier liquid preferably falls within a range of 0.1 to 5.0 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA LTD.).

After the colorant particles are dispersed in the carrier liquid, a charging control agent is added to the resultant carrier liquid to charge the colorant particles, and the charged colorant particles are dispersed in the resultant liquid to thereby produce the ink Q. Note that in dispersing the colorant particles in the carrier liquid, a dispersing agent may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16 (No. 2), p. 44, 1977.

Note that the colorant particles may be positively or negatively charged as long as the charged colorant particles are identical in polarity to the drive voltages applied to ejection electrodes.

In addition, the charging amount of colorant particles is preferably in a range of 5 to 200 μC/g, more preferably in a range of 10 to 150 μC/g, and much more preferably in a range of 15 to 100 μC/g.

In addition, the electrical resistance of the dielectric liquid may be changed by adding the charging control agent in some cases. Thus, a distribution factor P defined below is preferably equal to or larger than 50%, more preferably equal to or larger than 60%, and much more preferably equal to or larger than 70%.

$$P=100\times(\sigma 1-\sigma 2)/\sigma 1$$

where σ1 is an electric conductivity of the ink Q, and σ2 is an electric conductivity of a supernatant liquid which is obtained by inspecting the ink Q with a centrifugal separator. Those electric conductivities were obtained by measuring the electric conductivities of the ink and the supernatant liquid under a condition of an applied voltage of 5 V and a frequency of 1 kHz using an LCR meter of an AG-4311 type (manufactured by ANDO ELECTRIC CO., LTD.) and electrode for liquid of an LP-05 type (manufactured by KAWAGUCHI ELECTRIC WORKS, CO., LTD.). In addition, the centrifugation was carried out for 30 minutes under a condition of a rotational speed of 14,500 rpm and a temperature of 23° C. using a miniature high speed cooling centrifugal machine of an SRX-201 type (manufactured by TOMY SEIKO CO., LTD.).

The ink Q as described above is used, which results in that the colorant particles are likely to migrate and hence the colorant particles are easily concentrated.

The electric conductivity of the ink Q is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the ejection electrodes are not excessively high, and also there is no anxiety to cause the electrical conduction between the adjacent ejection electrodes.

In addition, the surface tension of the ink Q is preferably in a range of 15 to 50 mN/m, more preferably in a range of 15.5 to 45.0 mN/m, and much more preferably in a range of 16 to 40 mN/m. The surface tension is set in this range, resulting in that the applied voltages to the ejection electrodes are not excessively high, and also the ink does not leak or spread to the periphery of the head to contaminate the head.

Moreover, the viscosity of the ink Q is preferably in a range of 0.5 to 5.0 mPa·sec, more preferably in a range of 0.6 to 3.0 mPa·sec, and much more preferably in a range of 0.7 to 2.0 mPa·sec.

The ink Q can be prepared for example by dispersing colorant particles into a carrier liquid to form particles and adding a charging control agent to the dispersion medium to allow the colorant particles to be charged. The following methods are given as the specific methods.

(1) A method including: previously mixing (kneading) a colorant and/or dispersion resin particles; dispersing the resultant mixture into a carrier liquid using a dispersing agent when necessary; and adding the charging control agent thereto.

(2) A method including: adding a colorant and/or dispersion resin particles and a dispersing agent into a carrier liquid at the same time for dispersion; and adding the charging control agent thereto.

(3) A method including adding a colorant and the charging control agent and/or the dispersion resin particles and the dispersing agent into a carrier liquid at the same time for dispersion.

Note that, in the present invention, there is not adopted the process in which a force is caused to act on the overall ink to fly the ink towards the recording medium as in a conventional ink jet system, but there is adopted the process in which a force is caused to mainly act on the colorant particles as the solid components dispersed into the carrier liquid to fly the ink droplets each containing the colorant particles to the recording medium P.

As a result, an image can be recorded on various recording media such as a non-absorption film (such as a PET film) as well as plain paper. In addition, a high-quality image can be obtained on the various recording media without causing bleeding or flowing on the recording medium P.

An operation of ejection of ink droplets in the ink jet head 120 will be described below.

As described above, the surface of the recording medium P which is electrostatically attracted to the conveyor belt 38 acting as the counter electrode is uniformly charged to a predetermined negative high potential by the charger 44 for the recording medium P, and hence is in a state in which a constant bias voltage (about −1.5 kV) is always applied thereto. Note that the ink Q is caused to circulate at a predetermined speed in a direction indicated by an arrow a in FIG. 4A through the ink flow path 144.

In a state in which only the bias voltage is applied to the surface of the recording medium P, the Coulomb attraction between the bias voltage and the electric charges of the colorant particles of the ink, the Coulomb repulsion among the colorant particles, the viscosity of the carrier liquid, the surface tension, the dielectric polarization force and the like act on the ink, and these factors operate in conjunction with one another to move the charged colorant particles and the carrier liquid. Thus, the ink shows the meniscus shape in which the ink slightly rises from the through hole 138, thereby obtaining the balance.

In addition, the colorant particles are moved toward the recording medium P charged to the bias voltage through a so-called electrophoresis process by the Coulomb attraction and the like. That is, the ink is concentrated at the meniscus of the through hole 138.

Under this state, pulse voltages used to eject the ink droplets are applied (ejection is valid (ON)). That is, in the illustrated example, the pulse voltages each falling within a range of about 100 to about 600 V are applied from the corresponding pulse power supplies to the first and second ejection electrodes 131 and 132, respectively, to drive the first and second ejection electrodes 131 and 132, thereby ejecting the ink droplets.

As a result, the pulse voltages are superposed on the bias voltage, and hence the motion is caused in which the previous conjunction motion operates in conjunction with the superposition of the pulse voltages. Thus, the colorant particles and the carrier liquid are drawn toward the bias voltage side (counter electrode side), i.e., the recording medium P side through the electrophoresis process to form a so-called Taylor cone. In addition, similarly to the foregoing, the colorant particles are moved to the meniscus through the electrophoresis process so that the ink at the meniscus is concentrated and has a large number of colorant particles at a nearly uniform high concentration.

When a finite period of time further elapses after start of application of the pulse voltages to the first and second ejection electrodes 131 and 132, the balance mainly between the coulomb attraction acting on the colorant particles and the surface tension of the carrier liquid is broken at the tip portion of the meniscus having the high electric field strength applied thereto due to the movement of the colorant particles or the like. As a result, the meniscus abruptly grows to form a slender ink liquid column called a thread.

When a finite period of time further elapses, the formed thread is divided into parts due to the interaction resulting from the growth of the thread, the vibrations generated due to the Rayleigh/Weber instability, the ununiformity in distribution of the colorant particles within the meniscus, the ununiformity in distribution of the electrostatic field applied to the meniscus, and the like. The divided thread is then ejected and flown in the form of the ink droplets and is attracted by the bias voltage as well to adhere to the recording medium P.

The growth and division of the thread, and moreover the movement of the colorant particles to the meniscus (formed thread) are continuously generated while the pulse voltages are applied to the first and second ejection electrodes 131 and 132, respectively. That is, while the thread is formed, the ink droplets are intermittently flown towards the recording medium P. In addition, at a time point when the application of the pulse voltages to the first and second ejection electrodes 131 and 132 is completed (ejection is invalid (OFF)), the force for attracting the colorant particles and the carrier liquid toward the recording medium P side become weak, and hence the formed thread becomes small. Thus, after a predetermined period of time elapses, the state of the ink is returned back to the state of the meniscus in which only the bias voltage is applied to the surface of the recording medium P.

In the ink jet head 120, when the pulse voltages (drive voltages) are applied to the first and second ejection electrodes 131 and 132, respectively, as described above, the thread is formed and is then divided into parts, whereby the ink droplets are ejected and a part of an image for one dot is formed by a large number of fine ink droplets.

The ink jet head 120 as described above is used, and the ejection of the ink droplets from the ink jet head 120 is controlled by the head driver 56 in accordance with the image data while the serial scanning is carried out as described above, thereby forming a monochrome image. The state of ejection of ink droplets by the ink jet head 120 is also detected.

Note that, in this embodiment, the constant D.C. bias voltage is always applied to the surface of the recording medium P which is electrostatically attracted to the conveyor belt acting as the counter electrode, and in recording of an image, the pulse voltages corresponding to the image data are applied to the first and second ejection electrodes 131 and 132, respectively. However, it may also be adopted that the counter electrode side is grounded, and a constant D.C. bias voltage (e.g., −1.5 kV) is always applied to the side of the first and second ejection electrodes 131 and 132 of each of the ejection portions of the ink jet head 120 by the D.C. bias voltage applying device (not shown) for application of the bias voltage to the ink jet head 120.

Referring back to FIG. 1A, the description of the recording means 16 will be continued.

The head driver 56 is installed inside the casing 24 on its right-hand side in FIG. 1A, and is connected to the recording head 106 of the head unit 54.

The image data from an external device as well as the positional information of the recording medium P from the position detector 58 are inputted to the head driver 56. The ink is ejected from the ink jet head 120 based on image data while the ejection timing of the ink jet head 120 of the recording head 106 (see FIGS. 3-5C) is controlled based on the positional information of the recording medium P with the control made by the head driver 56. Thus, a monochrome image corresponding to the image data is recorded on the recording medium P.

That is, more specifically, as shown in FIG. 4A, the head driver 56 has the signal voltage source 57 including the voltage control portion 57*a* and the high voltage source 57*b*. The signal voltage source 57 applies the predetermined drive pulse voltage (in the image recording mode) or the predetermined drive D.C. voltage (in the detection mode) for allowing the ink droplets to be ejected, i.e., for allowing the ink droplets to be spontaneously ejected at the proper frequency, to the ejection electrodes 130 (the first and second ejection electrodes 131 and 132) of the ink jet head 120.

The high voltage source 57*b* is a D.C. power source for supplying a predetermined D.C. voltage of 400 to 600 V, for example. In the image recording mode, the voltage control portion 57*a* switches for the predetermined D.C. voltage supplied from the high voltage source 57*b* between on- and off-states in accordance with the image data to thereby generate the drive pulse voltage which corresponds to the image data and which is a predetermined D.C. voltage (in a range of 400 to 600 V, for example) at high level and the ground voltage (0 V) at low level. In the mode for detecting the spontaneous ejection property of the ink droplets, the voltage control portion 57*a* sets the predetermined D.C. voltage supplied from the high voltage source 57*b* as a drive D.C. voltage (in a range of 400 to 600 V for example). As a result, in the image recording mode, the signal voltage source 57 applies the predetermined drive pulse voltage which has been generated in the voltage control portion 57*a* so as to correspond to the image data, to each of the ejection electrodes 130 of the ejection portions of the ink jet head 120 to cause the ink droplets to be ejected from each of the ejection portions of the ink jet head 120 in accordance with the image data, and in the detection mode, applies the predetermined drive D.C. voltage (in the range of 400 to 600 V, for example) which has been supplied from the voltage control portion 57*a*, to the ejection electrodes 130 of one ejection portion 82 of the ink jet head 120 to cause the ink droplets to be spontaneously ejected from that ejection portion 82.

The position detector 58 for detecting the position of the recording medium P is conventionally known position detection means composed of a photo-sensor or the like. The position detector 58 is disposed in a position between the charger 44 and the head unit 54 along the conveyance path for the recording medium P. In this case, the position detector 58 is disposed in a position where the detector 58 is opposed to the surface of the conveyor belt 38 on which the recording medium P is conveyed.

The position of the recording medium P is detected by the position detector 58, and the resultant positional information is supplied to the head driver 56.

The ink circulation system 60 includes the ink tank 62, a pump (not shown), the ink supply passage 64, the ink recovery passage 66 and an ink replenishment tank 68.

The ink tank 62 is disposed inside the casing 24 on its bottom surface, and is connected to the head unit 54 through the ink supply passage 64 and the ink recovery passage 66.

The ink containing the colorant particles is collected in the ink tank 62. The ink collected in the ink tank 62 is supplied to the head unit 54 through the ink supply passage 64 by the pump. The ink which is not used in recording of an image is recovered into the ink tank 62 through the ink recovery passage 66.

In addition, a temperature control unit 62*a* for controlling the temperature of the ink to be ejected in the form of the ink droplet to suppress any of changes in temperature of the ink is mounted on the ink tank 62.

Any known temperature control unit can be used for the ink temperature control unit 62*a*. Examples thereof are a unit which includes a temperature control element or means such as a heating element or means (e.g., heater) and/or a heating/heat absorbing element (e.g., Peltier element) and/or cooling means (e.g., cooler) as well as a controller and a temperature sensor for the temperature control element or means, and which controls the temperature control element or means as described above by the controller in accordance with the ink concentration detected by the temperature sensor; and a unit which controls the temperature control element or means for example by a thermostat in which the temperature sensor is integrated with the controller. In addition, the temperature control unit 62*a* may be disposed anywhere as long as the temperature of the ink to be ejected in the form of the ink droplets can be adjusted and the ink tank 62 is not the sole place where the temperature control unit 62*a* is disposed. For example, the temperature control unit 62*a* may be disposed in the head unit 54, an ink piping system or the like.

The ink replenishment tank 68 includes a conc. (concentrated) liquid replenishment portion 68*a* and a diluted liquid replenishment portion 68*b*.

The conc. liquid replenishment portion 68*a* includes a conc. liquid tank for replenishing the ink tank 62 with conc. liquid (ink of relatively high concentration), and conc. liquid supplying means which connects the conc. liquid tank to the ink tank 62 and supplies as appropriate the conc. liquid from the conc. liquid tank to the ink tank 62.

In addition, the diluted liquid replenishment portion 68*b* includes a diluted liquid tank for replenishing the ink tank 62 with diluted liquid (ink of relatively low concentration), and diluted liquid supplying means which connects the diluted liquid tank to the ink tank 62 and supplies as appropriate the diluted liquid from the diluted liquid tank to the ink tank 62.

The solvent collection means 18 collects the dispersion solvent evaporating from the ink ejected from the recording head 106 onto the recording medium P, the dispersion solvent evaporating from the ink during image fixation, and the like. The solvent collection means 18 includes an exhaust fan 70 and an activated carbon filter 72. The activated carbon filter 72 is mounted on an upper rear surface of the casing 24, and the exhaust fan 70 is mounted onto the activated carbon filter 72.

The air containing the dispersion solvent components in the casing 24 is exhausted to the outside of the casing 24 through the activated carbon filter 72 by the exhaust fan 70. During the exhaust of the air, the dispersion solvent components contained in the air in the casing 24 are attracted and removed by the activated carbon filter 72.

Next, the ejection property detecting means 20 and the ejecting condition control means 22 as the characteristic portions of the present invention will be described in detail.

The ejection property detecting means 20 is used in the mode for detecting the spontaneous ejection property of the ink droplets. Thus, the ejection property detecting means 20 detects the spontaneous ejection property (the spontaneous ejection frequency or the number of spontaneous ejections per predetermined time period) of the ink droplets in the recording head 106. The ejection property detecting means 20 includes a detection portion 74, a bias electrode 76, and an arithmetic operation portion 78.

As shown in FIG. 1B, the bias electrode 76 functions as a counter electrode facing the recording head 106 (the ink jet head 120) of the head unit 54. The bias electrode 76 is flush with the conveyor belt 38, and is disposed in a position adjacent to the conveyor belt 38.

As described above, the drive means 104 can move the support member 100 of the head unit 54 along the guide rails 102*a* and 102*b* (see FIG. 2) in a direction perpendicular to the conveyance direction of the conveyor belt 38 (in the top-down direction on the paper plane of FIG. 1B). Thus, the recording head 106 (the ink jet head 120) provided in the support member 100 can be moved to a position where the head 106 faces the bias electrode 76.

The detection portion 74 is disposed between the bias electrode 76 and the head unit 54.

Figure 6:
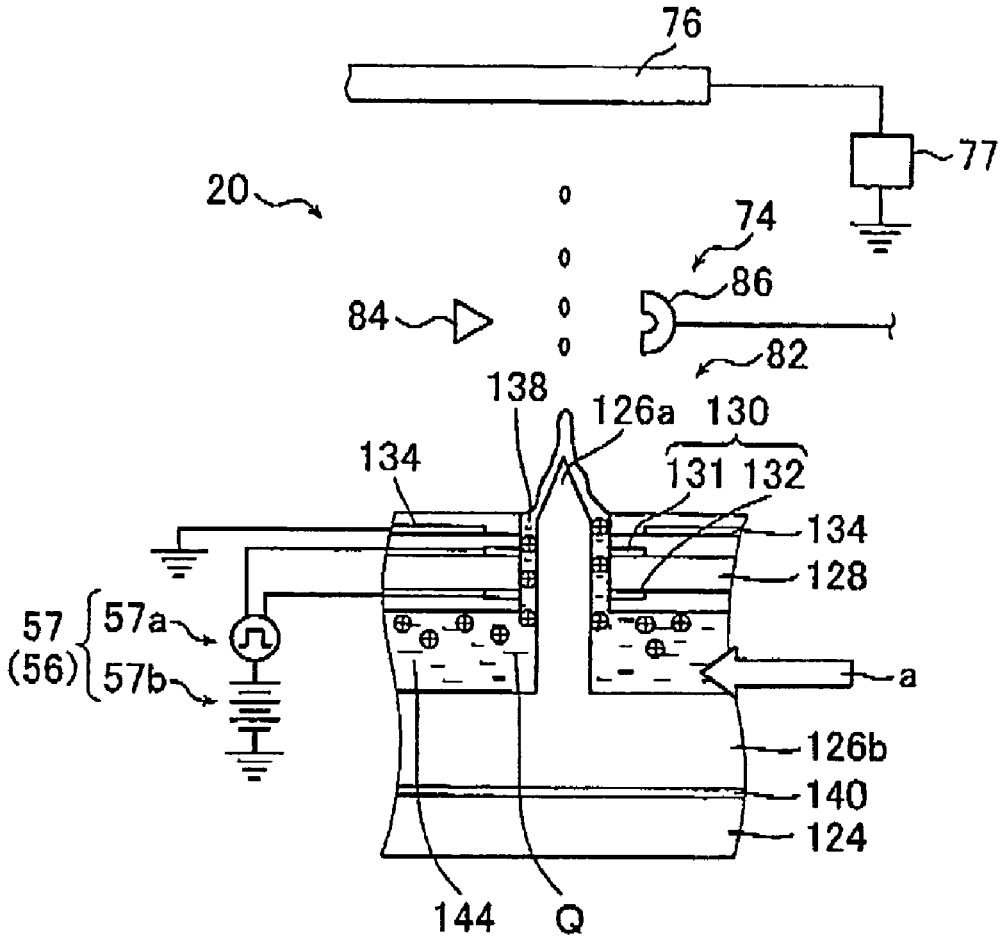
FIG. 6 is an enlarged schematic view showing the periphery of a detection portion shown in FIG. 1.

Hereinafter, the detection portion 74 will be described with reference to FIG. 6. FIG. 6 is a schematic view showing an example of the detection portion 74 and illustrates a state in which one ejection portion 82 of the ink jet head 120 is moved to a position where the ejection portion 82 faces the bias electrode 76.

The bias electrode 76 is connected to a variable D.C. voltage source 77 for applying a predetermined voltage allowing spontaneous ink droplet ejection at a predetermined frequency. In addition, as described above, the ink jet head 120 having the ejection portions 82 is disposed in the position where the head 120 faces the bias electrode 76. The ejection portion 82 shown in FIG. 6 is one of the ejection portions provided in the ink jet head 120 shown in FIG. 3.

When, for example, a predetermined negative high voltage (in a range of −1.5 to −2.0 kV) is applied from the variable D.C. voltage source 77 to the bias electrode 76, the meniscus is formed in the through hole 138 of the ejection portion 82 which will be described later, due to a conjunction of forces, and hence the ink Q is concentrated.

In this state, a predetermined positive high voltage (in a range of 400 to 600 V, for example) is applied from the signal voltage source 57 of the head driver 56 to the ejection electrodes 130 (the first and second ejection electrodes 131 and 132) of the ejection portion 82. When an inspection voltage obtained by superposing the voltage applied to the ejection electrodes 130 of the ejection portion 82 on the voltage applied to the bias electrode 76 becomes larger than the critical voltage for allowing the ink droplets to be spontaneously ejected, a predetermined electric field allowing ink droplet ejection from the ejection portion 82 is formed, and hence the meniscus grows to form a Taylor cone. Thereafter, a thread is formed. Then, the thread grows and is divided into parts. The divided thread passes in the form of the ink droplets through a predetermined path (flight path) to adhere to the bias electrode 76. in addition, the growth and division of the thread, and the movement of the colorant particles to the meniscus continuously occur and the spontaneous ejection of the ink droplets continues while the electric field allowing spontaneous ink droplet ejection is formed.

The detection portion 74 includes a light emitting element 84 and a light-receiving element 86. The detection portion 74 is disposed between the recording head 106 (the ink jet head 120) and the bias electrode 76. The light emitting element 84 and the light-receiving element 86 are disposed at a predetermined distance from each other across the flight path of the ink droplets which are spontaneously ejected from the above-mentioned ejection portion 82.

The light-emitting element 84 emits light having a fixed light quantity toward the light-receiving element 86. The light-receiving element 86 measures the quantity of the received light and transmits an output signal corresponding to the measured light quantity to the arithmetic operation portion 78.

The ink droplets which have been spontaneously ejected from the ejection portion 82 continuously pass through a space between the light emitting element 84 and the light receiving element 86.

Figure 7:
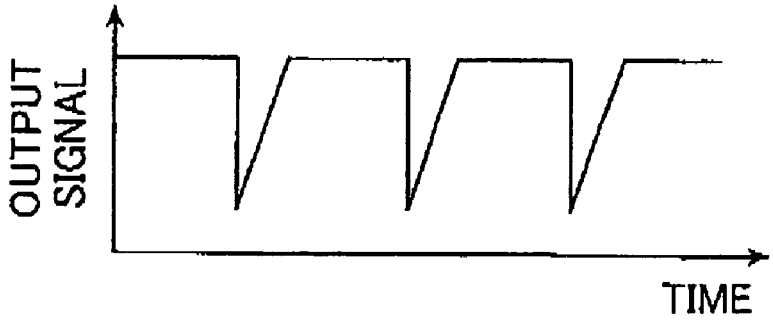
FIG. 7 is a graphical representation showing an example of an output signal detected by the detection portion shown in FIG. 6.

Whenever the ink droplet passes through the space between the light emitting element 84 and the light-receiving element 86, the light emitted from the light-emitting element 84 is cut off by the ink droplet. The light-receiving element 86 detects a change in light quantity due to the passage of the ink droplet through the space between the light-emitting element 84 and the light-receiving element 86. Thus, as shown in FIG. 7, whenever the ink droplet passes through the space between the light emitting element 84 and the light-receiving element 86, the light quantity detected by the light receiving element 86 changes.

The description of the ejection property detecting means 20 will be continued by referring to FIG. 1 again.

While the ink droplets are spontaneously ejected, the arithmetic operation portion 78 performs a predetermined processing, such as A/D conversion, on the output signal transmitted thereto from the light-receiving element 86 to thereby obtain light quantity data. The arithmetic operation portion 78 calculates an ejection timing (ejection state) for the ink droplets from the light quantity data based on a change in light quantity. Moreover, the arithmetic operation portion 78 calculates the spontaneous ejection property, e.g., the number of ink droplet ejections during a predetermined time period from the first ink droplet ejection, the ejection frequency, or the ejection frequency of the ink droplets during the period from the first ink droplet ejection until the predetermined number of ink droplets are ejected, based on the calculated ejection timing. The arithmetic operation portion 78 transmits data on the calculated ejection frequency of the ink droplets to an ejecting condition control portion 80.

Next, the ejecting condition control means 22 will be described.

The ejecting condition control means 22 includes the ejecting condition control portion 80 (hereinafter referred to as "the control portion 80"). Data on the previously detected ejection frequency (hereinafter referred to as "the proper frequency") for allowing an image to be suitably recorded is stored in the control portion 80.

In the mode for detecting the spontaneous ejection property, the control portion 80 controls the position adjustor 107 of the recording head 106 of the head unit 54, the signal voltage source 57 of the head driver 56, the variable D.C. voltage source 77, and the temperature control unit 62*a* of the ink tank 62 to adjust and set the ejecting conditions so that the ejection frequency whose data is transmitted from the arithmetic operation portion 78 to the control portion 80 becomes the proper frequency. The ejecting conditions, for example, include the potential difference between the ejection electrodes 130 and the bias electrode 76 (the recording medium P in the recording mode), the distance between the recording head 106 of the head unit 54 and the bias electrode 76 (the recording medium P or the conveyor belt 38 in the recording mode), and the ink temperature. Note that in the image recording mode, the control portion 80 controls the position adjustor 107 of the recording head 106, the signal voltage source 57 of the head driver 56, the variable D.C. voltage source 77, and the temperature control unit 62*a* of the ink tank 62 so that the set ejecting conditions are obtained. As a result, the ink droplets can be continuously and spontaneously ejected at the proper frequency while the drive pulse voltage is applied to the ejection electrodes 130.

In the detection mode, the potential difference between the ejection electrodes 130 and the bias electrode 76 can be adjusted by controlling the voltage applied to the bias electrode 76 by the variable D.C. voltage source 77 with respect to the voltage applied to the ejection electrodes 130 by the signal voltage source 57. The ejection frequency can be increased by reducing the voltage applied to the bias electrode 76, i.e., by increasing the potential difference, while the ejection frequency can be decreased by increasing the voltage applied to the bias electrode 76, i.e., by decreasing the potential difference.

In addition, the distance between the recording head 106 of the head unit 54 and the bias electrode 76 can be adjusted by controlling the position of the recording head 106 by the position adjustor 107. The ejection frequency can be increased by reducing the distance between the recording head 106 and the bias electrode 76, while the ejection frequency can be decreased by increasing the distance between the recording head 106 and the bias electrode 76.

Moreover, the ink temperature can be adjusted in accordance with the control made by the temperature control unit 62*a* of the ink tank 62. Thus, the ejection frequency can be increased by increasing the ink temperature, while the ejection frequency can be decreased by decreasing the ink temperature.

When the control portion 80 sets, in the detection mode, the ejecting conditions for allowing the spontaneous ejection frequency of the ink droplets to become the proper frequency, to be more specific, the potential difference between the ejection electrodes 130 and the bias electrode 76, the distance (gap) between the recording head 106 and the bias electrode 76, and the ink temperature as the proper potential difference (potential difference for drive), the proper distance (distance for drive), and the proper temperature (temperature for drive), respectively, in the image recording mode, the potential difference between the ejection electrodes 130 and the recording medium P, i.e., the superposition voltage obtained by superposing the drive pulse voltage applied to the ejection electrodes 130 by the signal voltage source 57 on the bias voltage applied to the recording medium P by the charger 44 is set at the proper potential difference. In addition, the distance between the recording head 106 and the surface of the conveyor belt 38 flush with the surface of the bias electrode 76 is automatically set at the proper distance, and the ink temperature is also set at the proper temperature.

Figure 8:
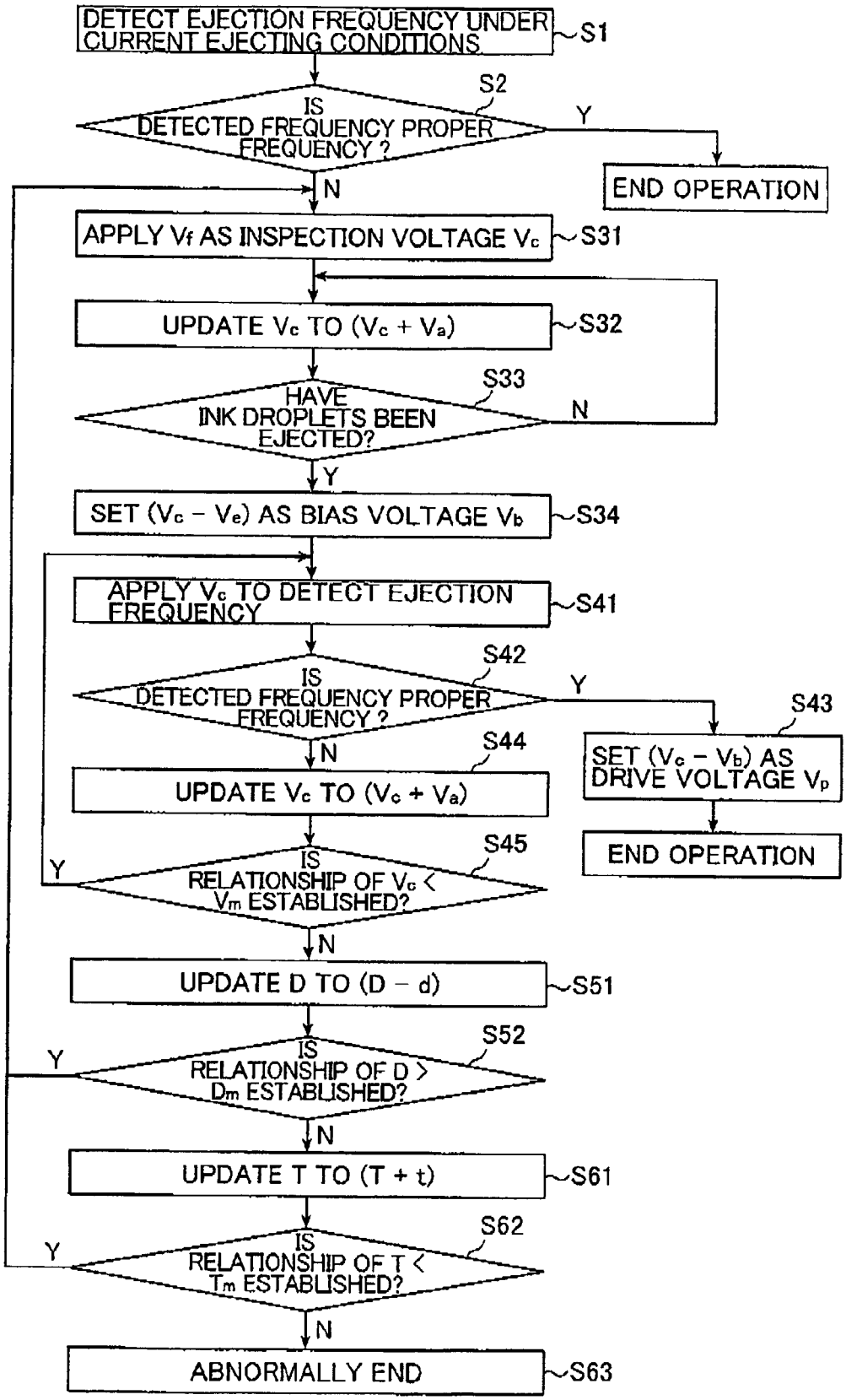
FIG. 8 is a flow chart explaining an embodiment of processing executed by a control portion shown in FIG. 1.

An example of a method of controlling the ejecting conditions by the control portion 80 will hereinafter be described with reference to FIG. 8. FIG. 8 is a flow chart illustrating an example of processing executed by the control portion 80.

In Step S1, the control portion 80 controls the drive means 104 to move the recording head 106 of the head unit 54 to the position where the head 106 faces the bias voltage 76. Then, the predetermined voltages based on the ejecting conditions are applied to the bias electrode 76 and the ejection electrodes 130, respectively, to eject the ink droplets. The ejection frequency of the ink droplets is detected by the ejection property detecting means 20 and the detection results are transmitted from the arithmetic operation portion 78 to the control portion 80. Then, the operation proceeds to Step S2.

In Step S2, it is judged whether or not the ejection frequency (hereinafter referred to as "the detected frequency") whose data has been transmitted from the arithmetic operation portion 78 is the proper frequency. When the judgment results show that the detected frequency is the proper frequency, the processing by the control portion 80 ends. On the other hand, when the judgment results show that the detected frequency is not the proper frequency, the operation proceeds to Step S31.

In Step S31, the control portion 80 controls the variable D.C. voltage source 77 and the signal voltage source 57 to apply a predetermined voltage Vf as a superposition voltage Vc (hereinafter referred to as "an inspection voltage Vc") across the bias electrode 76 and the ejection electrodes 130. Note that the superposition voltage Vc is obtained by superposing the voltage (e.g., the positive voltage) applied to the ejection electrodes 130 on the voltage (e.g., the negative voltage) applied to the bias electrode 76. Thus, for example, the superposition voltage Vc is a voltage value with the negative electric potential of the bias electrode 76 taken as zero, and hence means the potential difference between the bias electrode 76 and the ejection electrodes 130. Consequently, in the following description, the voltage is expressed in terms of the potential difference. The predetermined voltage Vf refers to a voltage at which the ink droplets are not ejected. If the ink droplets are spontaneously ejected even when the voltage Vf is applied, the voltage Vf is reduced.

In Step S32, the control portion 80 increases the inspection voltage Vc by a fixed voltage Va. That is, the control portion 80 adjusts the voltage to be applied to the bias electrode 76 and the ejection electrodes 130 by the variable D.C. voltage source 77 so that Vc+Va becomes a new inspection voltage Vc. Then, the operation proceeds to Step S33. The voltage Va is used to obtain the critical ejection voltage above which the ink droplets are spontaneously ejected. Thus, the voltage Va is preferably somewhat small when the voltage Va is gradually increased. However, the voltage Va is not particularly limited, and thus may be suitably set based on the magnitude of the inspection voltage Vc, the precision required for the critical ejection voltage, and the tolerance.

In Step S33, it is judged whether or not the ink droplets have been ejected based on the detected frequency whose data has been transmitted from the arithmetic operation portion 78 that has received the output signal from the light-receiving element 86 of the detection portion 74. When the judgment results show that any of the ink droplets have not yet been ejected, the operation proceeds to Step S32. On the other hand, when the judgment results show that the ink droplets have been ejected, the current inspection voltage Vc and the previous inspection voltage (Vc−Va) are obtained as the ejection voltage and the non-ejection voltage between which the critical ejection voltage exists, respectively. Then, the operation proceeds to Step S34. Note that at this time, the critical ejection voltage may be estimated from the current inspection voltage Vc and the previous inspection voltage (Vc−Va), and thus, for example, a voltage (Vc−Va/2) may be set as the critical ejection voltage.

In Step S34, the control portion 80 sets a voltage lower than the inspection voltage Vc at which the ink droplets were ejected or the estimated critical ejection voltage (Vc−Va/2) by a predetermined voltage Ve, that is, a voltage (Vc−Ve) or (Vc−Va/2−Ve), as the bias voltage Vb during the recording. Then, the operation proceeds to Step S41. It is to be understood that the bias voltage Vb needs to be a voltage at which no spontaneous ejection will certainly take place.

In Step S41, the control portion 80 applies the inspection voltage Vc across the bias electrode 76 and the ejection electrodes 130 to eject the ink droplets. Then, the control portion 80 instructs the detection portion 74 of the ejection property detecting means 20 to detect the ejection frequency of the ink droplets, and also instructs the detection portion 74 to transmit the data on the detected ejection frequency to the arithmetic operation portion 78. Then, after the arithmetic operation portion 78 transmits the data on the ejection frequency to the control portion 80, the operation proceeds to Step S42.

In Step S42, it is judged whether or not the detected frequency is the proper frequency. When the judgment results show that the detected frequency is the proper frequency, the operation proceeds to Step S43. On the other hand, when the judgment results show that the detected frequency is not the proper frequency, the operation proceeds to Step S44.

In Step S43, after a voltage obtained by subtracting the bias voltage Vb set in Step S34 from the inspection voltage Vc, i.e., a voltage (Vc−Vb) is set as a pulse voltage Vp during the recording, the control portion 80 ends the processing. Note that the processing of Step S34 for obtaining the bias voltage Vb may be executed in any of the steps located after S33 and before S43.

In Step S44, the inspection voltage Vc is increased by the predetermined voltage Va. That is, the inspection voltage Vc is updated to a new voltage (Vc+Va). Then, after the voltages which are to be applied to the bias electrode 76 and the ejection electrodes 130, respectively, are adjusted so that the new inspection voltage Vc is obtained, the operation proceeds to Step S45.

In Step S45, it is judged whether or not the inspection voltage Vc is lower than a predetermined voltage Vm. When the judgment results show that the inspection voltage Vc is lower than the predetermined voltage Vm, i.e., Vc<Vm, the operation proceeds to Step S41. On the other hand, when the judgment results show that the inspection voltage Vc is equal to or higher than the predetermined voltage Vm, i.e., Vc≧Vm, the operation proceeds to Step S51.

When both the voltages applied to the ejection electrodes 130 and the bias electrode 76 (or the recording medium P) are high, there is a possibility that discharge occurs between the ejection electrodes 130 and the bias electrode 76, and thus the recording can not be safely carried out. Hence, the predetermined voltage Vm indicates a maximum critical potential difference at which no such discharge occurs and thus the recording can be safely carried out.

In Step S51, the distance between the recording head 106 of the head unit 54 and the bias electrode 76 is set. More specifically, the distance D between the recording head 106 and the bias electrode 76 is shortened by a fixed distance d. That is, the distance D is updated so that the distance (D−d) becomes a new distance D between the recording head 106 and the bias electrode 76. Thus, after the recording head 106 is moved by the position adjustor 107 so that the new distance D is obtained, the operation proceeds to Step S52.

In Step S52, it is judged whether or not the distance D between the recording head 106 and the bias electrode 76 is longer than a predetermined distance Dm. When the judgment results show that the distance D between the recording head 106 and the bias electrode 76 is longer than the predetermined distance Dm, i.e., D>Dm, the operation proceeds to Step S31. On the other hand, when the judgment results show that the distance D between the recording head 106 and the bias electrode 76 is equal to or shorter than the predetermined distance Dm, i.e., D≦Dm, the operation proceeds to Step S61.

When the distance between the recording head 106 and the bias electrode 76 is short, there is a possibility that discharge occurs between the recording head 106 and the bias electrode 76, and thus the recording can not be safely carried out. Hence, the predetermined distance Dm is a minimum critical distance at which no discharge occurs between the recording head 106 and the bias electrode 76 and thus the recording can be safely carried out.

In Step S61, the ink temperature is set. More specifically, the temperature control unit 62*a* of the ink tank 62 increases the ink temperature T by a fixed temperature t. That is, the ink temperature T is updated so that an ink temperature (T+t) becomes a new ink temperature T. Then, after the temperature control unit 62*a* adjusts the ink temperature to the new ink temperature T, the operation proceeds to Step S62.

In Step S62, it is judged whether or not the ink temperature T is lower than a predetermined temperature Tm. When the judgment results show that the ink temperature T is lower than the predetermined temperature Tm, i.e., T<Tm, the operation proceeds to Step S31. On the other hand, when the judgment results show that the ink temperature T is equal to or higher than the predetermined temperature Tm, i.e., T≧Tm, the operation proceeds to Step S63.

The predetermined temperature Tm is, for example, a critical temperature above which the ink is modified, an upper limit temperature above which the ink evaporates, or the like.

In Step S63, since the detected frequency does not become the proper frequency by the adjustment of the voltages (the bias voltage and/or the pulse voltage) applied to the ejection electrodes 130 of the recording head 106 and the bias electrode 76, the distance between the recording head 106 and the bias electrode 76, and the ink temperature, the processing by the control portion 80 are abnormally ended.

In this way, the ejecting conditions such as the voltages (the bias voltage and/or the pulse voltage) applied to the ejection electrodes 130 of the recording head 106 and the bias electrode 76, the distance between the recording head 106 and the bias electrode 76, and the ink temperature are suitably adjusted in the detection mode based on the ejection frequency detected, whereby the ejecting conditions are also suitably set in the image recording mode in the same manner, and thus the ink droplets can be spontaneously ejected at the desired proper spontaneous ejection frequency. When the spontaneous ejection frequency during the image formation is fixed at the desired proper frequency, it is possible to fix the number of ink droplets ejected according to the image data, and the size of each ink droplet. Hence, the image quality of the recorded image can be kept constant.

In this way, in the detection mode, the ejecting conditions are adjusted so that the spontaneous ejection frequency (ejection state) becomes proper and fixed, whereby also in the image recording mode, the ejecting conditions can be suitably set. As a result, the ink droplets can be spontaneously ejected at the proper frequency for a long time. Thus, image recording, which has been hitherto unstable due to various factors such as the gap between the ink jet head and the recording medium, the resistance of the recording medium, a change in physical properties of the ink, and other changes over time as described above, is stabilized. Hence, high-quality images can be stably recorded for a long time.

When the ejecting conditions set by the ejection property detecting means 20 and the ejecting condition control means 22 are set as the ejecting conditions for the image recording, since the relation between the ejecting conditions and the ejection frequency (ejection state) at the time of adjustment of the ejecting conditions is different from that at the time of image recording, this difference may be for example stored as a correction value in the control portion 80 in advance so that the ejecting conditions which were detected and set at the time of adjustment of the ejecting conditions can be corrected based on the stored correction value and the ejecting conditions obtained as a result of the correction can be set as the ejecting conditions at the time of image recording.

In addition, the ejecting condition control method with which the ejecting conditions are adjusted and set is not limited to the above-mentioned method. That is, in order to obtain the critical ejection voltage and the inspection voltage Vc at which the proper spontaneous ejection frequency is obtained, conventionally known convergence methods can be applied to the ejecting condition control method. For example, instead of adding the fixed voltage Va, the fixed voltage Va may be repeatedly subtracted from a high inspection voltage value that was firstly set as an initial value. Alternatively, a variable voltage value may be added or subtracted, or the voltage value to be added to or subtracted from an initial value may be gradually reduced as by half. In addition, these are not the sole methods for controlling the ejecting conditions. Thus, the potential difference between the ejection electrode of the recording head and the bias electrode (the recording medium or the counter electrode), the bias voltage and the drive voltage, the distance between the recording head and the bias electrode (the recording medium), and the temperature of the ink may be adjusted in any order or combination. For example, the ejecting conditions may be adjusted only for the ink temperature and the drive voltage. In this embodiment, the distance between the recording head of the head unit and the bias electrode is adjusted based on the position of the recording head, but the present invention is not intended to be limited thereto. That is, the adjustment of the distance between the ejection means for ejecting the ink droplets and the bias electrode will suffice. The head unit may be moved to adjust the position of the head unit to thereby adjust the position of the recording head, although the apparatus size is increased.

The method of controlling the ejecting conditions according to another embodiment will hereinafter be described.

Figure 9:
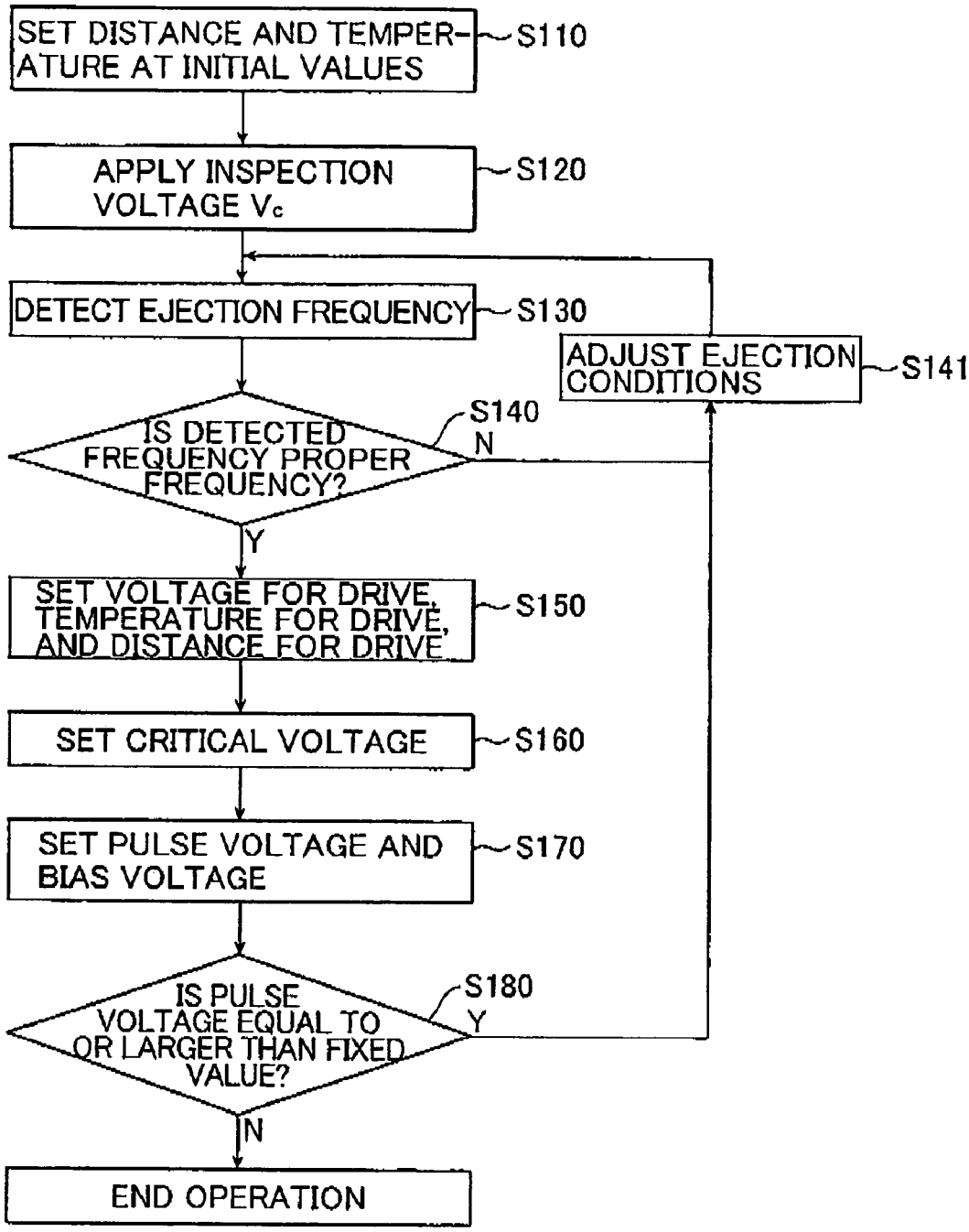
FIG. 9 is a flow chart explaining another embodiment of processing executed by the control portion shown in FIG. 1.

FIG. 9 is a flow chart illustrating processing executed by the control portion 80 using the method of controlling the ejecting conditions according to another embodiment.

In Step S110, after the control portion 80 moves the recording head 106 of the head unit 54 to the position where the head 106 faces the bias electrode 76, the control portion 80 controls the position adjustor 107 of the recording head 106 and the temperature control unit 62*a* in the detection mode so that the distance between the recording head 106 and the bias electrode 76, and the ink temperature may be an initial distance and an initial temperature having been set in advance, respectively. Then, the operation proceeds to Step S120.

In Step S120, the voltage which allows the ink droplets to be spontaneously ejected is set as the voltage Vc (hereinafter referred to as "the inspection voltage") to be applied across the bias electrode 76 and the ejection electrodes 130. The inspection voltage Vc thus set is applied across the bias electrode 76 and the ejection electrodes 130 by controlling the variable D.C. voltage source 77 and the signal voltage source 57. Then, the operation proceeds to Step S130.

In Step S130, the control portion 80 instructs the ejection property detecting means 20 (including the detection portion 74 and the arithmetic operation portion 78) to detect the ejection frequency (hereinafter referred to as "the detected frequency") of the ink droplets which were ejected by applying the inspection voltage Vc across the bias electrode 76 and the ejection electrodes 130. Then, the ejection property detecting means 20 transmits the data on the detected frequency to the control portion 80. Then, the operation proceeds to Step S140.

In Step S140, the control portion 80 judges whether or not the detected frequency is a proper frequency. When the control portion 80 judges that the detected frequency is not the proper frequency, the operation proceeds to Step S141. On the other hand, when the control portion 80 judges that the detected frequency is the proper frequency, the operation proceeds to Step S150.

In Step S141, when the detected frequency is lower than the proper frequency, at least one of further increasing the inspection voltage Vc, shortening the distance between the recording head 106 and the bias electrode 76, and increasing the ink temperature is carried out. On the other hand, when the detected frequency is higher than the proper frequency, at least one of further decreasing the inspection voltage Vc, increasing the distance between the recording head 106 and the bias electrode 76, and decreasing the ink temperature is carried out. Next, the operation proceeds to Step S130.

In Step S150, the distance between the recording head 106 and the bias electrode 76, the ink temperature, and the inspection voltage Vc when the detected frequency is judged to be the proper frequency are set as the distance for drive, the temperature for drive, and the voltage for drive, respectively. Then, the operation proceeds to Step S160.

In Step S160, the set voltage for drive is gradually decreased and the critical ejection voltage below which the ink droplets will not be spontaneously ejected, or two voltages, i.e., the ejection voltage and the non-ejection voltage between which the critical ejection voltage exists are detected. Thus, the operation proceeds to Step S170.

In Step S170, a voltage lower than the detected critical ejection voltage, a voltage lower than the detected non-ejection voltage, or the detected non-ejection voltage is set as the bias voltage to be applied during the recording, and a voltage obtained by subtracting the bias voltage from the voltage for drive is set as the drive pulse voltage. Then, the operation proceeds to Step S180.

In Step S180, it is judged whether or not the drive pulse voltage thus set is equal to or smaller than a maximum allowable value. When the judgment results show that the drive pulse voltage thus set is larger than the maximum allowable value, it means that the set ejecting conditions are not proper, and thus the operation proceeds to Step S141. On the other hand, when the judgment results show that the drive pulse voltage thus set is equal to or smaller than the maximum allowable value, it means that the set ejecting conditions are proper, and the processing by the control portion 80 ends.

The ejecting conditions can also be properly adjusted by utilizing such a control method. In addition, in this control method, the bias voltage and the pulse voltage are set based on the voltage for drive after the ejecting conditions for allowing the ink droplets to be ejected at the proper frequency are detected. Hence, the bias voltage can be set by one operation.

Since the ejection characteristics do not abruptly change in the electrostatic ink jet recording apparatus of the present invention, the adjustment and setting of the ejecting conditions by utilizing the method of controlling the ejecting conditions may be carried out each time a predetermined time period elapses or whenever a user finds a change in the recorded image while observing the recorded image. Thus, a high-quality image can be always formed in a sufficiently stable manner through such adjustment.

In addition, the bias electrode 76 is preferably provided with a cleaning mechanism for cleaning the ink droplets adhering to the bias electrode 76. Any conventionally known unit may be used for the cleaning mechanism. By cleaning the bias electrode 76 in this way, the ink droplets can be ejected without changing the ejecting conditions.

In this embodiment, the voltages are applied from the variable D.C. voltage source 77 and the signal voltage source 57 to the bias electrode 76 and the ejection electrodes 130, respectively, to cause a desired potential difference between the bias electrode 76 and the ejection electrodes 130, thereby forming the electric field necessary for the spontaneous ejection of the ink droplets in the ejection portion 82. However, the method of forming the electric field is not particularly limited. That is, the voltage may be applied to only the bias electrode 76 to eject the ink droplets spontaneously, the voltage may be applied to only the ejection electrodes 130 to eject the ink droplets spontaneously, or electric field forming means for forming an electric field may be separately provided.

Note that, when the voltage is applied to only the bias electrode 76 to spontaneously eject the ink droplets, the ink droplets are spontaneously ejected from other ejection portions as well as from the ejection portion 82 at which the ejecting conditions of the ink droplets are measured. Thus, as in the above-mentioned embodiment, the desired voltage is preferably applied to only the ejection electrodes 130 of one ejection portion 82.

In addition, while the ejection frequency of the ink droplets is calculated based on the ejection timing, and the ejecting conditions are adjusted based on the calculated ejection frequency, the present invention is not limited thereto. Alternatively, the ejection state as defined by the ejection intervals, the number of ejections per predetermined time period, and the like may be detected based on the ejection timing, and the ejecting conditions may be adjusted based on the detected ejection state so that suitable image recording can be carried out. In this case as well, data on the ejection state allowing suitable image recording may be stored in the control portion in advance, and the ejecting conditions may be adjusted so as to obtain that ejection state.

In addition, in this embodiment the bias electrode 76 is separately installed so as to lie on the same plane as that of the surface of the conveyor belt 38 serving as the counter electrode in an adjacent position to the conveyor belt 38, and in the detection mode, the head unit 54 is moved so that the recording head 106 (the ink jet head 120) comes to the position where the head 106 faces the bias electrode 76. However, the present invention is not limited thereto. Alternatively, the detection portion 74 of the ejection property detecting means 20 may be moved to be positioned between the recording medium P and the recording head 106 of the head unit 54, and in this state, the ink droplets ejected toward the recording medium P may be measured. In addition, the ink droplets ejected toward the conveyor belt 38 may be measured without placing the recording medium P thereon. Also, when the ink droplets are ejected toward the conveyor belt 38, it is necessary to provide a cleaning mechanism for cleaning the conveyor belt 38.

While in this embodiment the optical means is used as the detection portion of the ejection property detecting means and the ejection state of the ink droplets is measured by the optical means, the present invention is not limited thereto. Alternatively, the ejection state of the ink droplets may also be detected by electrical means.

Figure 10:
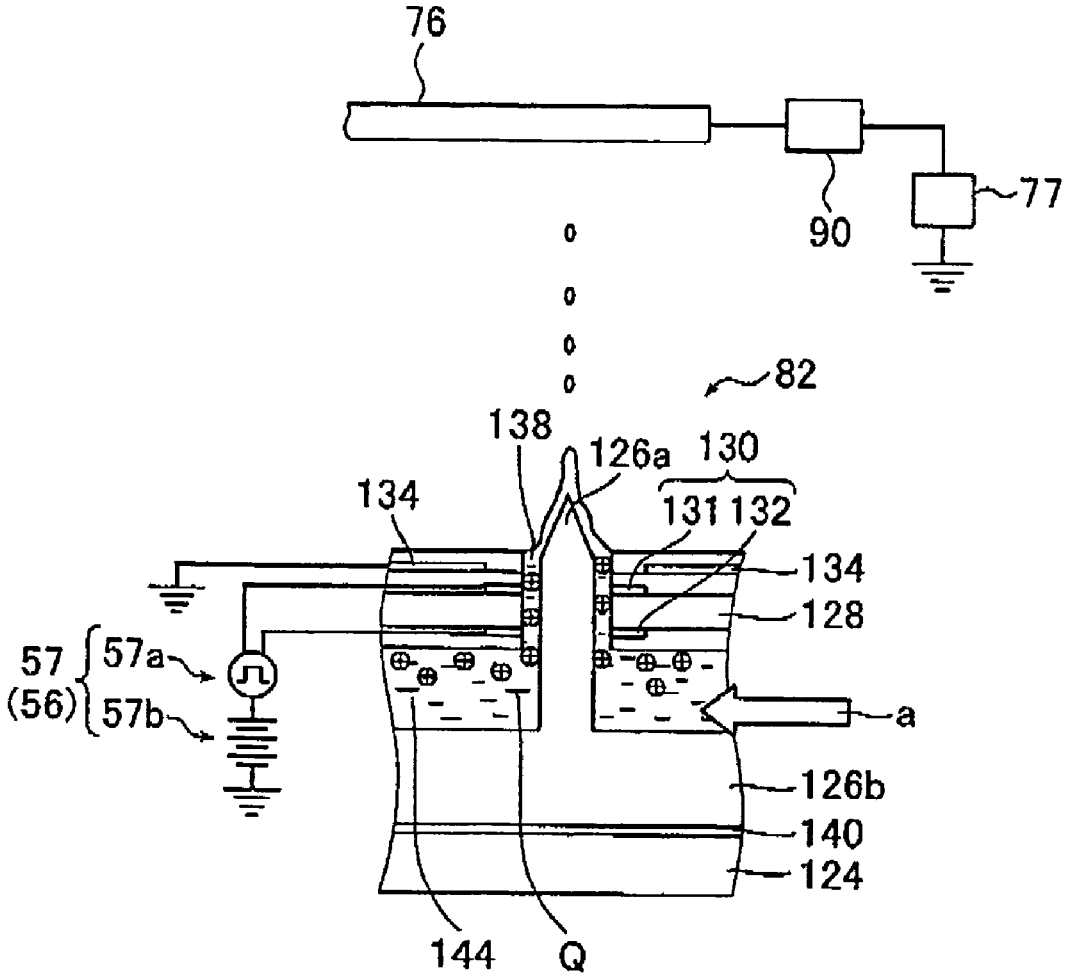
FIG. 10 is an enlarged schematic view showing another embodiment of the detection portion of the present invention.

FIG. 10 shows a schematic structural view of an embodiment of electrical detection means which is used as the detection portion of the ejection property detecting means and which is applied to one ejection portion 82 of the recording head 106 (the ink jet head 120).

Note that the embodiment shown in FIG. 10 has the same constitution as that of the embodiment shown in FIG. 6 except a detection portion. Thus, the same constituent elements as those in the embodiment shown in FIG. 6 are designated with the same reference numerals, and their detailed descriptions are omitted here for the sake of simplicity. Thus, the following description will focus on the feature peculiar to this embodiment.

A detection portion 90 is connected to the bias electrode 76 measures a value of the current caused to flow through the bias electrode 76 and transmits an output signal corresponding to the measured current value to the arithmetic operation portion 78. When the ink droplets are spontaneously ejected from the ejection portion 82 as in the above-mentioned embodiment, the ejected ink droplets adhere to the bias electrode 76. When the ejected ink droplets adhere to the bias electrode 76, a current corresponding to a charging amount of adhering ink droplets is caused to flow through the bias electrode 76 since charged colorant particles are contained in the ink droplets. Hence, the current value detected by the detection portion 90 changes. In addition, while the ink droplets are caused to fly and move toward the bias electrode 76, a displacement current due to the electric charges of the ink droplets is caused to flow, and this displacement current may be detected by the detection portion.

As in the above-mentioned embodiment shown in FIG. 6, the arithmetic operation portion 78 subjects an output signal from the detection portion 90 to the predetermined processing to obtain current value data, and calculates the ejection timing (ejection state) for the ink droplets based on a change in the current value data. As in the above-mentioned embodiment, the arithmetic operation portion 78 can calculate the ejection frequency based on the calculated ejection timing.

An operation of the ink jet recording apparatus 10 will hereinafter be described.

In the ink jet recording apparatus 10, when an image is to be recorded, sheets of the recording medium P accommodated in the sheet feeding tray 30 are taken out one by one by the feed roller 32, and are then held and conveyed by the conveyance roller pair 36 to be supplied to a predetermined position on the conveyor belt 38.

The recording medium P which has been supplied onto the conveyor belt 38 is charged to a negative high electric potential by the charger 44 to be electrostatically attracted to the surface of the conveyor belt 38.

An image corresponding to image data is recorded on the surface of the recording medium P electrostatically attracted to the surface of the conveyor belt 38 while the recording medium P is moved at a predetermined constant speed as the conveyor belt 38 moves.

The electric charges on the surface of the recording medium P after completion of the image recording are removed by the discharger 46, and the recording medium P is then separated from the surface of the conveyor belt 38 by the separation claw 48. Then, the image recorded on the surface of the recording medium P is heated and fixed while the recording medium P is held and conveyed by the fixing roller pair 52 along the guide 50. Thus, the sheets of the recording medium P are stocked within the sheet-discharging tray 34 while being stacked one upon another.

In the ink jet recording apparatus 10 for recording an image on the surface of the recording medium P in this way, the adjustment for the ejecting conditions is carried out periodically or at an arbitrary timing by utilizing the method of controlling the ejecting conditions according to the present invention.

When the ejecting conditions are to be adjusted, the ink jet recording apparatus 10 is placed in the detection mode, and first of all, the support member 100 of the head unit 54 is moved so that the recording head 106 comes to the position where the head 106 faces the bias electrode 76. The requisite voltage is applied to the bias electrode 76 by the variable D.C. voltage source 77.

Next, the requisite voltage is applied from the signal voltage source 57 to the ejection electrodes 130 of one ejection portion 82 of the recording head 106 which is moved so that the flight path of the ejected ink droplets is located between the light-emitting element 84 and the light receiving element 86. As a result, the requisite potential difference is set between the ejection electrodes 130 and the bias electrode 76 to thereby form the electric field allowing spontaneous ejection of the ink droplets in the ejection portion 82. Then, as described above, the Taylor cone is formed, the thread is formed, and the thread is divided into parts. Then, the divided thread is spontaneously ejected in the form of ink droplets from the ejection portion 82, and the ink droplets then pass through the space between the light emitting element 84 and the light-receiving element 86 to adhere to the bias electrode 76.

While the ink droplets are spontaneously ejected from the ejection portion 82, the light receiving element 86 measures the quantity of the received light and transmits the output signal corresponding to the quantity of the received light to the arithmetic operation portion 78.

The arithmetic operation portion 78 subjects the output signal transmitted thereto from the light-receiving element 86 to the predetermined processing such as the A/D conversion to obtain the light quantity data. Then, the arithmetic operation portion 78 calculates the ejection timing based on a change in the light quantity data, and calculates the ejection frequency based on the ejection timing thus calculated to transmit the data on the ejection frequency to the control portion 80.

The control portion 80 adjusts the ejecting conditions such as the potential difference between the ejection electrodes 130 and the bias electrode 76, the bias voltage, the drive pulse voltage, the distance between the recording head 106 and the bias electrode 76, and the ink temperature, and carries out the control so that the detected ejection frequency becomes the proper ejection frequency for allowing an image to be suitably recorded. Thus, the control portion 80 sets the potential difference between the ejection electrodes 130 and the bias electrode 76, the bias voltage, the drive pulse voltage, the distance between the recording head 106 and the bias electrode 76, and the ink temperature as the ejecting conditions which allow spontaneous ejection of the ink droplets at the proper frequency.

As described above, in the detection mode, the ejection of the ink droplets is actually measured, and the ejecting conditions are adjusted based on the ejection state of the ink droplets, thereby allowing the ejecting conditions to be precisely set. Thus, in the image recording mode as well as in the detection mode, the ink droplets can be spontaneously ejected at the proper frequency for a long time period. Hence, in the image recording mode, a high-quality image can be stably recorded for a long time period.

Here, while in this embodiment the serial head type head unit is used as the head unit 54, the present invention is not limited thereto. That is, it is to be understood that a so-called line head type head unit having a line of ejection portions corresponding to the entire area of the recording medium may of course be used as the head unit 54.

In addition, while in this embodiment the recording of a monochrome image is described, the present invention is not limited thereto. For example, full color printing may also be carried out using four colors of cyan(C), magenta(M), yellow (Y), and black(K). In this case, the head unit may be provided for each of the four colors, or the ink jet heads corresponding to the four colors may be provided in one recording head.

The above-mentioned embodiments are merely shown as examples of the present invention. Thus, it is to be understood that the present invention should not be limited to those embodiments, and hence changes or improvements may be suitably made without departing from the gist of the present invention.

What is claimed is:

1. A method of controlling an ink jet recording apparatus which ejects ink droplets toward a recording medium to record an image on said recording medium by causing an electrostatic force to act on ink containing charged colorant particles, comprising:

applying continuously a predetermined constant D.C. voltage to ink ejecting means such that spontaneous ejection of said ink droplets in which said ink droplets are ejected spontaneously and continuously from said ink ejecting means occurs;

detecting a spontaneous ejection property of the ejected ink droplets which are ejected spontaneously and continuously from said ink ejecting means by said spontaneous ejection; and controlling ejecting conditions for said ink droplets in accordance with the detected spontaneous ejection property, wherein said ejection property is a spontaneous ejection frequency of said ink droplets or the number of spontaneous ejections of said ink droplets per predetermined time, and wherein said ejecting conditions include at least one of a potential difference between a recording medium and an ink ejecting means for ejecting said ink droplets, a distance between said ink ejecting means and a counter electrode provided opposite to said ink ejecting means, and a temperature of said ink wherein said distance, said temperature and said potential difference are set as an initial distance, an initial temperature and a detection potential difference at which spontaneous ejection of said ink droplets occurs, respectively, said spontaneous ejection frequency or said number of spontaneous ejections is detected at said detection potential difference;

a detected value of said ejection frequency or said number of spontaneous ejections is compared with a desired value of the ejection frequency or the number of spontaneous ejections to obtain a comparison result;

said potential difference, said distance and said temperature of said ink are updated according to the comparison result;

said spontaneous ejection frequency or said number of spontaneous ejections is repeatedly detected while updating said potential difference, said distance and said temperature of said ink until said detected value coincides with the desired value or falls within a tolerance of the desired value;

said updated potential difference, said updated distance and said updated temperature of said ink are set as a potential difference for drive, a distance for drive, and a temperature for drive, respectively, when said detected value coincides with the desired value or falls within a tolerance of the desired value;

an ejection potential difference and a non-ejection potential difference between which a critical potential difference as a critical value at which spontaneous ejection of the ink droplets occurs exists are obtained by decreasing said updated potential difference;

a potential difference lower than said critical potential difference, or a potential difference equal to or lower than said non-ejection electric potential is set as a bias electric potential to be applied across said ink ejecting means and said recording medium; and a difference between said potential difference for drive and said bias potential difference is set as a drive pulse potential difference.

2. The method according to claim 1, wherein when the detected value is smaller than the desired value, said updating is carried out by at least one of further increasing the potential difference, shortening the distance, and increasing the ink temperature, while when the detected value is larger than the desired value, said updating is carried out by at least one of decreasing the potential difference, increasing the distance, and decreasing the ink.

3. An ink jet recording apparatus for ejecting ink droplets toward a recording medium to record an image on said recording medium by causing an electrostatic force to act on ink containing charged colorant particles, comprising:

ink ejecting means for ejecting said ink droplets by causing a predetermined electrostatic force to act on said ink;

spontaneous ejection control means for controlling said ink ejecting means such that spontaneous ejection of said ink droplets in which said ink droplets are ejected spontaneously and continuously from said ink ejecting means occurs by applying continuously a predetermined constant D.C. voltage to said ink ejecting means;

ejection property detecting means for detecting a spontaneous ejection property of said ink droplets said spontaneous ejection of which has occurred under control by said spontaneous ejection control means; and ejecting condition control means for controlling ejecting conditions for said ink droplets according to said spontaneous ejection property detected by said ejection property detecting means, further comprising a detecting mode of said spontaneous ejection property of said ink droplets and a image recording mode, wherein said ink ejecting means has nozzles for ejecting said ink droplets and ejection electrodes, each being provided around each ejection electrode, in the detecting mode, said predetermined constant D.C. voltage is continuously applied to each ejection electrode, said spontaneous ejection of said ink droplets occurs and said ink droplets are ejected spontaneously and continuously from each nozzle, and in the image recording mode, a drive pulse voltage is applied to each of said ejection electrodes in a pulsed manner in accordance with image signals for recording said image on said recording medium, and said ink droplets are ejected image wise from each nozzle on said recording medium to record said image on said recording medium.

4. A method of controlling an ink jet recording apparatus which ejects ink droplets toward a recording medium to record an image on said recording medium by causing an electrostatic force to act on ink containing charged colorant particles, comprising:

applying continuously a predetermined constant D.C. voltage to ink ejecting means such that spontaneous ejection of said ink droplets in which said ink droplets are ejected spontaneously and continuously from said ink ejecting means occurs;

detecting a spontaneous ejection property of the ejected ink droplets which are ejected spontaneously and continuously from said ink ejecting means by said spontaneous ejection; and controlling ejecting conditions for said ink droplets in accordance with the detected spontaneous ejection property, further comprising:

preparing a detecting mode of said spontaneous ejection property of said ink droplets and an image recording mode, wherein said ink ejecting means has nozzles for ejecting said ink droplets and ejection electrodes, each being provided around each ejection electrode, in the detecting mode, said predetermined constant D.C. voltage is continuously applied to each ejection electrode, said spontaneous ejection of said ink droplets occurs and said ink droplets are ejected spontaneously and continuously from each nozzle, and in the image recording mode, a drive pulse voltage is applied to each of said ejection electrodes in a pulsed manner in accordance with image signals for recording said image on said recording medium, and said ink droplets are ejected image wise from each nozzle on said recording medium to record said image on said recording medium.

* * * * *